US010775719B2

(12) United States Patent
Sakamoto et al.

(10) Patent No.: US 10,775,719 B2
(45) Date of Patent: Sep. 15, 2020

(54) DUCT MECHANISM AND IMAGE FORMING APPARATUS INCLUDING THE SAME

(71) Applicant: SHARP KABUSHIKI KAISHA, Sakai, Osaka (JP)

(72) Inventors: Masafumi Sakamoto, Sakai (JP); Hideaki Kadowaki, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/231,563

(22) Filed: Dec. 23, 2018

(65) Prior Publication Data

US 2019/0196369 A1 Jun. 27, 2019

(30) Foreign Application Priority Data

Dec. 27, 2017 (JP) ..... 2017-250780

(51) Int. Cl.
*G03G 15/20* (2006.01)
*G03G 21/20* (2006.01)

(52) U.S. Cl.
CPC ..... *G03G 15/2017* (2013.01); *G03G 21/206* (2013.01); *G03G 2221/1645* (2013.01)

(58) Field of Classification Search
CPC ..... G03G 15/2017; G03G 21/206; G03G 2221/1645
USPC ..... 399/92
See application file for complete search history.

(56) References Cited

U.S. PATENT DOCUMENTS

| | | | | |
|---|---|---|---|---|
| 9,052,690 | B2 * | 6/2015 | Udagawa | G03G 21/206 |
| 9,141,080 | B2 * | 9/2015 | Mitorida | G03G 21/206 |
| 10,241,452 | B2 * | 3/2019 | Yamashita | G03G 21/16 |
| 2007/0071485 | A1 * | 3/2007 | Yuasa | G03G 21/206 399/92 |
| 2007/0212104 | A1 * | 9/2007 | Miyamoto | G03G 21/206 399/92 |
| 2010/0054791 | A1 * | 3/2010 | Shimizu | G03G 15/6573 399/92 |
| 2012/0315061 | A1 * | 12/2012 | Kondo | G03G 15/2017 399/92 |
| 2019/0196397 | A1 * | 6/2019 | Sakamoto | G03G 21/206 |
| 2019/0196398 | A1 * | 6/2019 | Sakamoto | G03G 21/206 |

FOREIGN PATENT DOCUMENTS

JP 2012-141645 A 7/2012

* cited by examiner

*Primary Examiner* — Robert B Beatty
(74) *Attorney, Agent, or Firm* — ScienBiziP, P.C.

(57) ABSTRACT

An image forming apparatus includes an apparatus body and an exhaust unit. The exhaust unit includes a first duct and a first exhaust fan provided in the first duct. The first exhaust fan suctions air inside the first duct and sends the suctioned air to an outside of the apparatus body. The first duct is disposed at a position adjacent to the fixing unit. The first duct is divided into a plurality of air flow paths.

10 Claims, 14 Drawing Sheets

DUCT MECHANISM AND IMAGE FORMING APPARATUS INCLUDING THE SAME

BACKGROUND

1. Field

The present disclosure relates to a duct mechanism used in an image forming apparatus and an image forming apparatus including the same. Specifically, the present disclosure relates to a duct mechanism that restrains heat of a fixing device included in an image forming apparatus from being transferred to the inside of the apparatus, and an image forming apparatus including the same.

2. Description of the Related Art

Japanese Unexamined Patent Application Publication No. 2012-141645 discloses an example of the image forming apparatus in the related art. An image forming apparatus in the related art includes a fixing device, a driving roller disposed in the vicinity of the fixing device, and an exhaust duct provided above the fixing device. The exhaust duct constitutes an axially extending tubular air flow passage such as a heating roller and a driving roller of the fixing device. Further, the exhaust duct communicates with a first space provided between the fixing device and the driving roller, and an exhaust fan is provided in the exhaust duct for discharging the air in the first space to the outside of the image forming apparatus.

In the image forming apparatus in the related art, since a direction in which air is suctioned into the exhaust duct and a direction in which air flows in the exhaust duct are different from each other, the flow of air in the exhaust duct is not uniform and unevenness occurs. Therefore, when heat of the fixing portion is thermally insulated by the exhaust duct, there is a problem in that the heat is not uniformly insulated, and thereby unevenness occurs in the heat insulating effect of the exhaust duct.

Therefore, it is desirable to provide a new duct mechanism.

It is also desirable to provide a duct mechanism which can effectively insulate the heat of the fixing unit without unevenness, in the duct mechanism used in the image forming apparatus.

SUMMARY

According to a first aspect of the disclosure, there is provided a duct mechanism used in an image forming apparatus including an apparatus body; a fixing unit that is provided in the apparatus body, and heats and fixes a toner image transferred to a recording medium. The duct mechanism includes a first duct disposed at a position adjacent to the fixing unit and an exhaust fan for discharging air of the first duct to the outside of the apparatus body. The inside of the first duct is divided into a plurality of air flow paths.

DESCRIPTION OF THE EMBODIMENTS

First Embodiment

Figure 1:
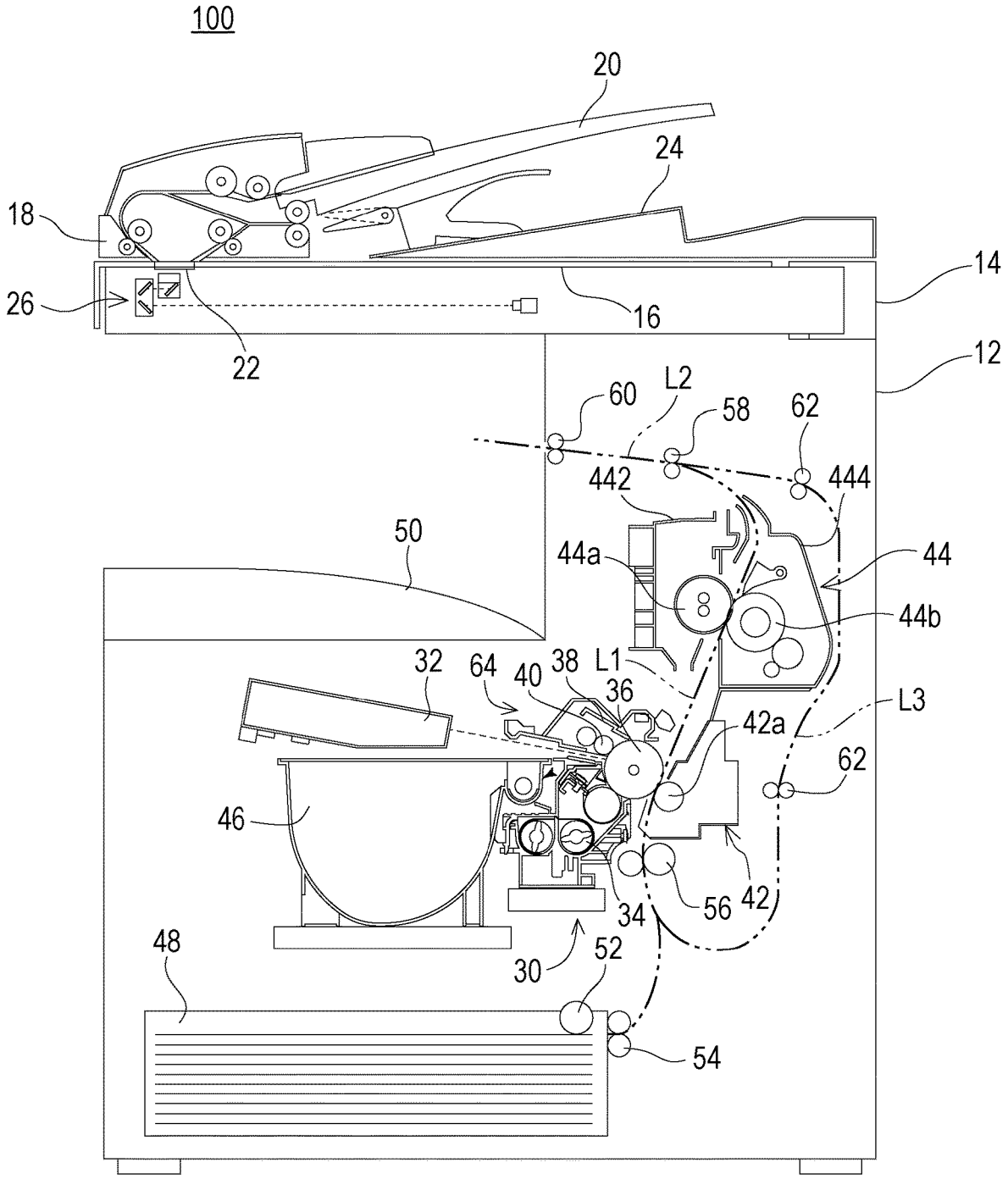
FIG. 1 is a schematic view illustrating a schematic configuration of an image forming apparatus which is a first embodiment of the disclosure in a case of being viewed from a front surface.

FIG. 1 is a schematic view illustrating a schematic configuration of an image forming apparatus 100 which is a first embodiment of the disclosure. The image forming apparatus 100 illustrated in FIG. 1 is a multifunction printer having a copying function, a printer function, a scanner function, and a facsimile function, and forms a monochrome image on a recording medium by electrophotography. The recording medium can be a sheet or an overhead projector sheet, but the following description explains the use of the sheet.

In this specification, out of the horizontal direction in a case where the image forming apparatus 100 is viewed from the front surface, the left side is defined as a left direction and the right side is defined as a right direction. The front surface side of the image forming apparatus 100 is defined as a forward direction (front surface direction) in the backward direction in a case where the image forming apparatus 100 is viewed from above (below), and the rear surface side of the image forming apparatus 100 is defined as a backward direction (rear surface direction).

First, a configuration of the image forming apparatus 100 will be schematically described. As illustrated in FIG. 1, the image forming apparatus 100 includes an apparatus body 12 provided with an image forming unit 30, and an image reading device 14 disposed above the apparatus body.

The image reading device 14 includes a document placing table 16 formed of a transparent material. Above the document placing table 16, a document pressing cover 18 is openably and closably attached via a hinge or the like. A document feeding tray 20 is provided on an upper surface of the document pressing cover 18, and an automatic document feeder (ADF) is provided therein. The ADF automatically feeds the document placed on the document feeding tray 20 one by one to the image reading position 22 and ejects the document to the document discharging tray 24.

The image reading unit 26 incorporated in the image reading device 14 includes a light source, a plurality of mirrors, an imaging lens, and a line sensor. The image reading unit 26 exposes the surface of the document by a light source and guides the reflected light reflected from the surface of the document to the imaging lens by the plurality of mirrors. Then, the reflected light is imaged on the light-receiving element of the line sensor by the imaging lens. In the line sensor, brightness and chromaticity of the reflected light formed on the light-receiving element are detected, and image data based on the image of the surface of the document is generated. As a line sensor, a charge coupled device (CCD), a contact image sensor (CIS), or the like can be used.

On the front surface side of the image reading device 14, there is provided an operation panel (not shown) for receiving an input operation such as a print instruction by a user. The operation panel has a display with a touch panel and a plurality of operation buttons.

In addition, a control unit (not shown) including a CPU, a memory, and the like is provided in the apparatus body 12. The control unit transmits control signals to various parts of the image forming apparatus 100 and performs various operations on the image forming apparatus 100 in accordance with an input operation to the operation panel and the like.

The image forming unit 30 includes an exposure unit (optical scanning unit) 32, a developing unit 34, a photosensitive drum 36, a cleaner unit (cleaning unit) 38, a charging unit 40, a transfer unit 42, a fixing unit 44, and a toner supply device 46, and forms an image on a sheet transported from the sheet feeding cassette 48 or the like, and the ejects the sheet on which the image formed to an sheet ejecting tray 50. As image data for forming an image on the sheet, image data read by the image reading unit 26 or image data transmitted from an external computer or the like is used.

The photosensitive drum 36 is an image holding member having a photosensitive layer formed on the surface of a conductive cylindrical base and is configured to be rotated about axis by a rotary driving source (not shown) such as a motor. The charging unit 40 charges the surface of the photosensitive drum 36 to a predetermined potential. The exposure unit 32 is configured as a laser scanning unit (LSU) including a laser emitting unit and a reflecting mirror, and exposes the surface of the charged photosensitive drum 36 to form an electrostatic latent image corresponding to image data on the surface of the photosensitive drum 36. The developing unit 34 includes a developer tank (developing housing) for containing toner, supplies toner to the surface of the photosensitive drum 36, visualizes the electrostatic latent image formed on the surface of the photosensitive drum 36 with toner (a toner image is formed). A toner concentration detection sensor for detecting the toner concentration is provided in the developer tank. When the toner concentration detected by this toner concentration detection sensor becomes lower than a predetermined value, toner is supplied from the toner supply device 46 to the developer tank. The cleaner unit (cleaning unit) 38 includes a cleaning blade 382 (refer to FIG. 12) that abuts against the surface of the photosensitive drum 36 and a transport screw, removes toner remaining on the surface of the photosensitive drum 36 after development and image transfer, and then transports the removed toner to a waste toner box (not shown). However, in the image forming apparatus 100 of the first embodiment, the photosensitive drum 36, the charging unit 40, and the cleaner unit 38 are unitized, and are detachably provided as a process unit 64 including these units in the apparatus body 12.

The transfer unit 42 is a unit for transferring a toner image formed on the surface of the photosensitive drum 36 onto a sheet, and includes a transfer roller 42*a* provided so as to press the photosensitive drum 36, and the like. When an image is formed, a predetermined voltage is applied to the transfer roller 42*a*, and thereby a transfer electric field is formed between the photosensitive drum 36 and the transfer roller 42*a*. With this action of the transfer electric field, while the sheet passes through a transfer nip portion between the photosensitive drum 36 and the transfer roller 42*a*, the toner image formed on the outer peripheral surface of the photosensitive drum 36 is transferred onto the sheet.

The fixing unit 44 includes a heat roller (fixing roller) 44*a* and a pressure roller 44*b*, and is disposed above the transfer unit 42 (the downstream side in the sheet transport direction). Further, the heat roller 44*a* is disposed on the sheet ejecting tray 50 side (left side) with respect to the pressure roller 44*b*. Further, the heat roller 44*a* is supported by a first support member 442, and the pressure roller 44*b* is supported by a second support member 444. Further, the first support member 442 is configured to surround three sides of the upper surface (top surface), the left side surface (one side surface), and the lower surface (bottom surface) of the heat roller 44*a*. The second support member 444 is configured to surround three sides of an upper surface (top surface), a right side surface, and a lower surface (bottom surface) of the pressure roller 44*b*.

The heat roller 44*a* is set to be at a predetermined fixing temperature (for example, 160° C.), and when the sheet passes through the fixing nip portion between the heat roller 44*a* and the pressure roller 44*b*, the toner image transferred to the sheet is melted, mixed, and pressed, and thus is thermally fixed (heated and fixed) on the sheet.

In such an apparatus body 12, the first sheet transport path L1, the second sheet transport path L2, and a third sheet transport path L3, to which a sheet is transported, are formed. The first sheet transport path L1 is provided to send the sheet transported from the sheet feeding cassette 48 and the like to the register roller 56, the transfer unit 42, and the fixing unit 44. The second sheet transport path L2 is provided to send the sheet after thermal fixing by the fixing unit 44 to the sheet ejecting tray 50, following the first sheet transport path L1. The third sheet transport path L3 is a path for transporting the sheet after single-sided printing and passing through the fixing unit 44, from the second sheet transport path L2 to the first sheet transport path L1 on the upstream side in the sheet transport direction of the transfer roller 42*a* (the transfer nip portion). Here, the image forming apparatus 100 of the first embodiment is a so-called vertical transport type image forming apparatus. Therefore, in the first sheet transport path L1 and the second sheet transport path L2, the sheet is transported from the lower side to the upper side. On the other hand, in the third sheet transport path L3, the sheet is transported from the upper side to the lower side. Hereinafter, the term "sheet transport direction" simply means the sheet transport direction (direction from the lower side to the upper side) in the first sheet transport path L1 and the second sheet transport path L2.

The sheet feeding cassette 48 is provided with the sheet feeding tray for storing sheets, a pick-up roller 52 for picking up sheets stored in the sheet feeding tray one by one and supplying them to the first sheet transport path L1, and a separation roller 54. The second sheet transport path L2 is provided with a transport roller 58 for imparting a propelling force to the sheet, and an ejecting roller 60 for ejecting the sheet to the sheet ejecting tray 50. Further, on the third sheet transport path L3, a transport roller 62 for applying the propelling force to the sheet is appropriately provided.

When single-sided printing is performed in the apparatus body 12, the sheet is guided one by one from the sheet feeding cassette 48 to the first sheet transport path L1 and transported to the register roller 56. Then, the register roller 56 transports the sheet to the transfer nip portion at a timing when the leading edge of the sheet and the leading edge of image information (toner image) on the photosensitive drum 36 are aligned, and the toner image is transferred onto the sheet. Thereafter, by passing through the fixing unit 44 (fixing nip portion), an unfixed toner on the sheet is thermally fixed. Thermal fixed sheet is transported to the second sheet transport path L2 by the transport roller 58 and the ejecting roller 60, and is ejected to the sheet ejecting tray 50.

On the other hand, at the time of performing dual-sided printing, when the printing on the front side is finished and a trailing end portion of the sheet having passed through the fixing unit 44 reaches the ejecting roller 60, the ejecting roller 60 and the transport roller 58 are reversely rotated, and thereby the sheet reversely travels and is guided from the second sheet transport path L2 to the third sheet transport path L3. The sheet guided to the third sheet transport path L3 is transported to the third sheet transport path L3 by the transport roller 62 and guided to the first sheet transport path L1 of the register roller 56. Since the front and back of the sheet are reversed at this point, thereafter, the sheet passes through the transfer nip portion and the fixing nip portion, and thereby the printing is performed on the rear surface side of the sheet.

In the image forming apparatus 100 as described above, a manual sheet feeding tray is provided, or an external sheet feeding unit is mounted in some cases. In such a case, in place of the sheet feeding cassette 48, a sheet may be fed from the manual sheet feeding tray or the sheet feeding unit to the first sheet transport path L1.

Figure 2:
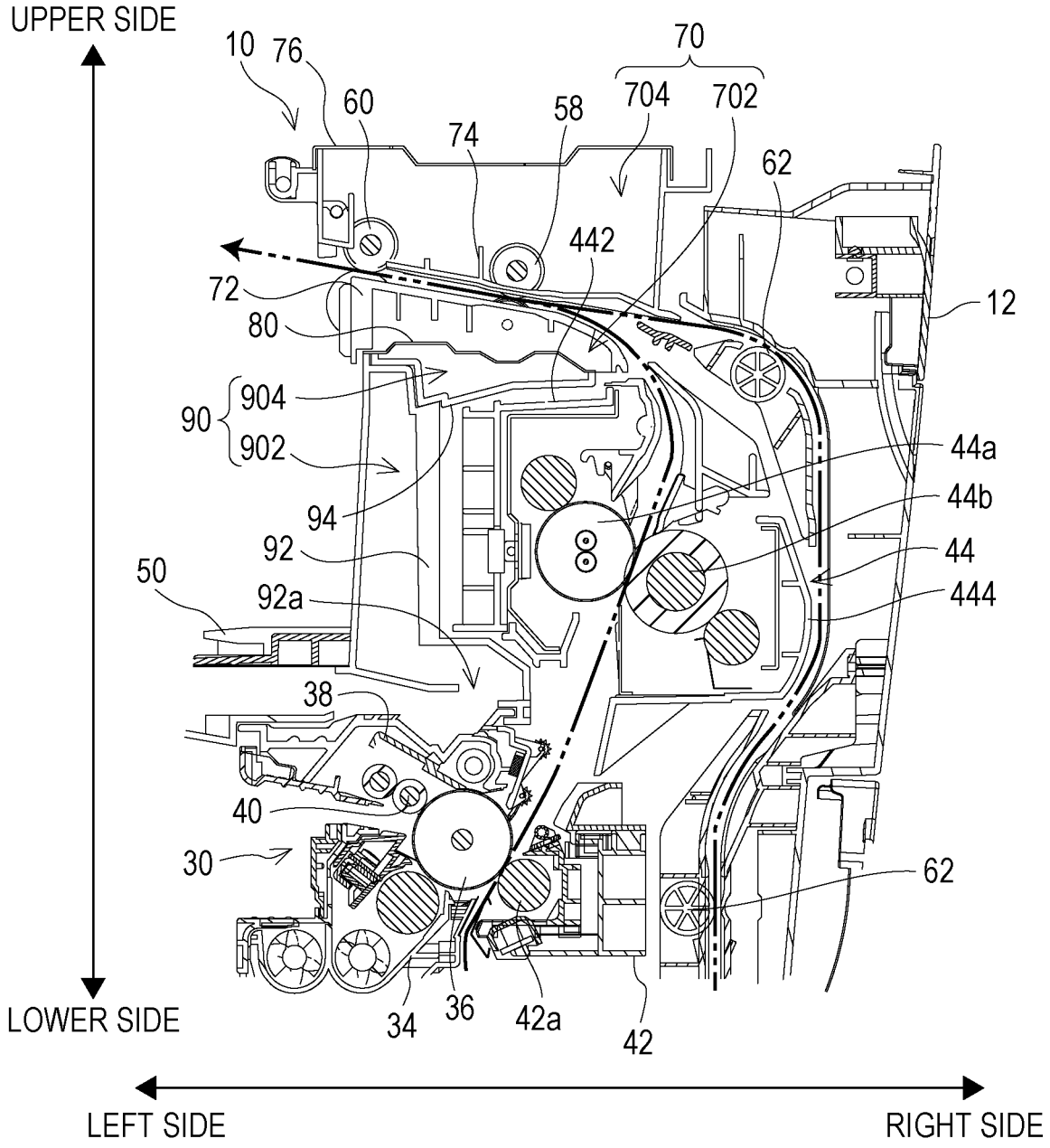
FIG. 2 is a schematic sectional view illustrating a structure of an exhaust portion provided in the image forming apparatus illustrated in FIG. 1.
Figure 3:
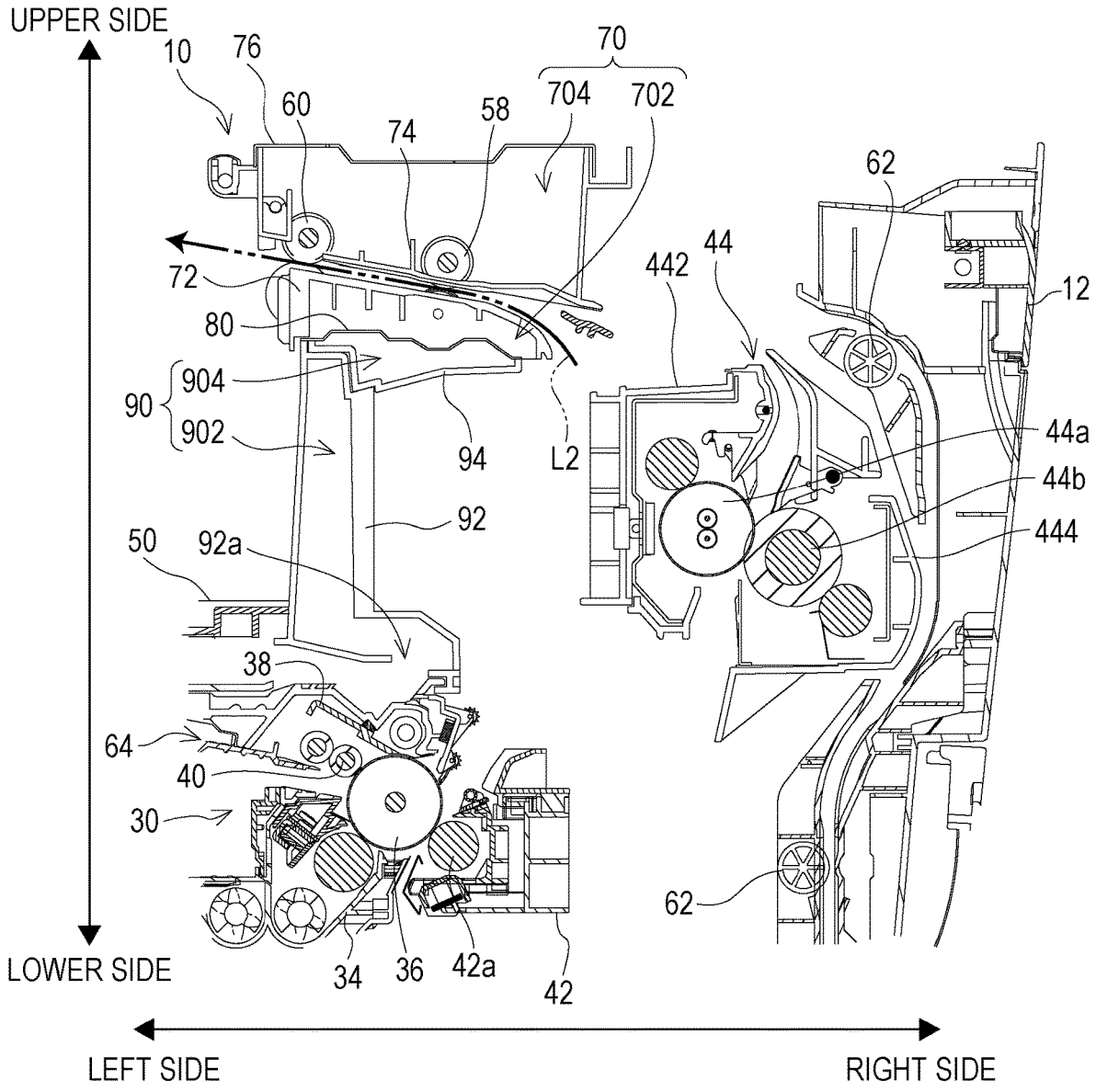
FIG. 3 is a schematic sectional view illustrating the structure of the exhaust unit in a state where a fixing unit is separated.
Figure 4:
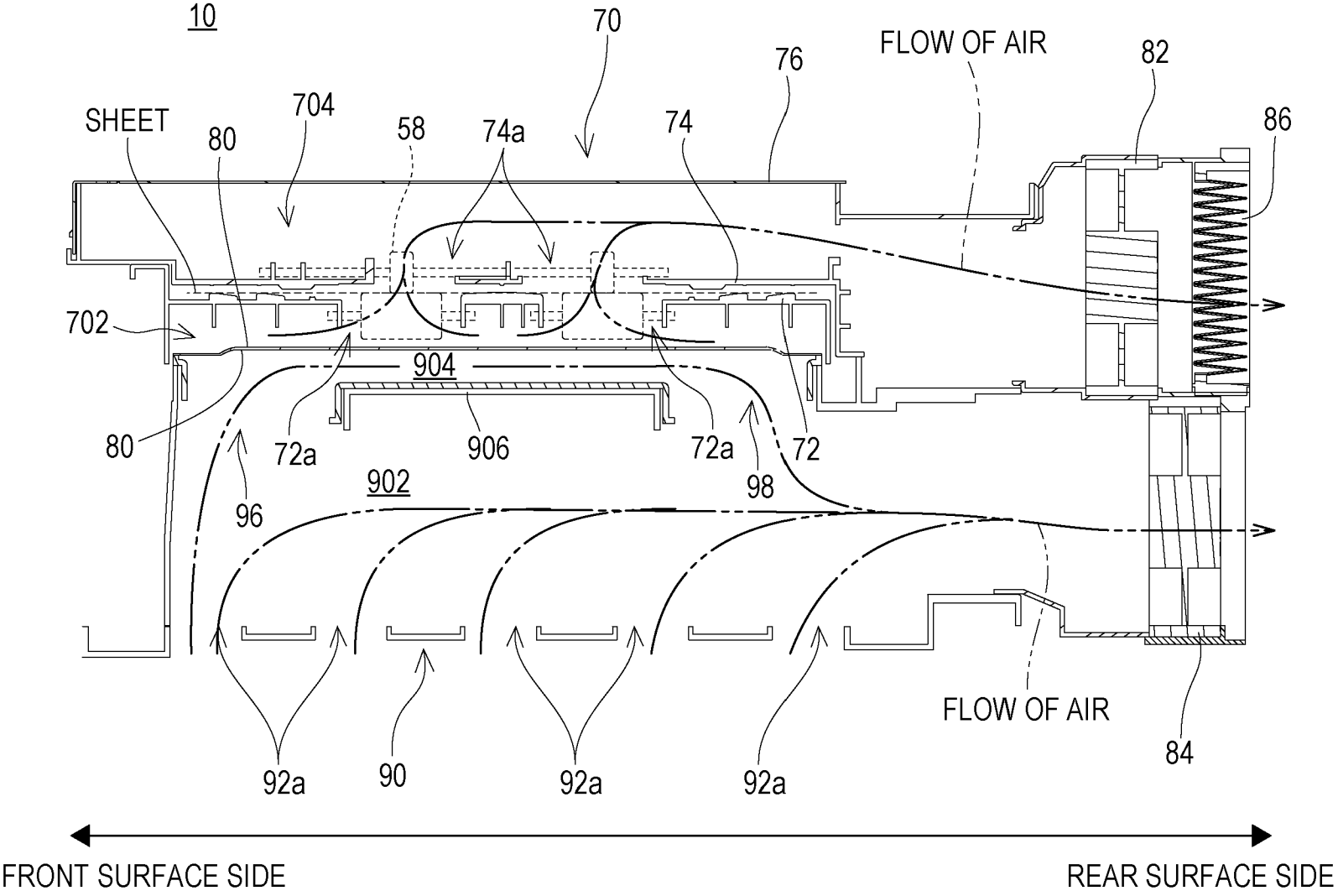
FIG. 4 is a schematic sectional view illustrating a flow of air in a fine particle collecting duct and a first duct.
Figure 5:
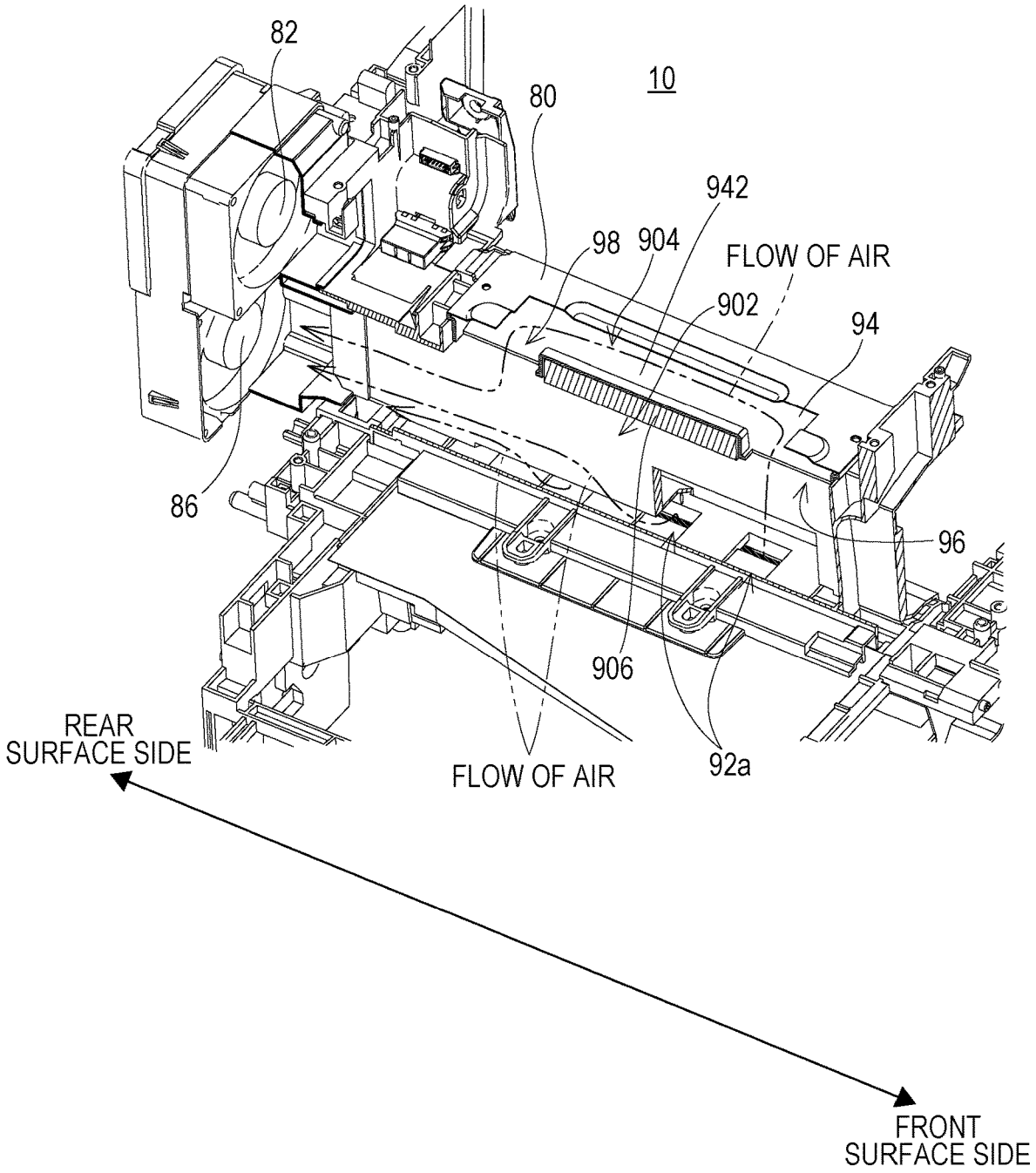
FIG. 5 is a schematic sectional view illustrating the flow of air in the first duct.

Further, the image forming apparatus 100 of the first embodiment includes an exhaust unit (exhaust device) 10 that discharges the air in the apparatus body 12 to the outside of the apparatus body 12. Hereinafter, the structure of the exhaust unit 10 will be described with reference to the drawings. FIG. 2 is a schematic sectional view illustrating a structure of the exhaust unit 10 provided in the image forming apparatus 100 illustrated in FIG. 1. FIG. 3 is a schematic sectional view illustrating the structure of the exhaust unit 10 in a state where the fixing unit 44 is separated. FIG. 4 is a schematic sectional view illustrating a flow of air in a fine particle collecting duct 70 and a first duct 90. FIG. 5 is a schematic sectional view illustrating the flow of air in the first duct 90.

As illustrated in FIGS. 2 and 3, the exhaust unit 10 includes the fine particle collecting duct 70 and the first duct 90. Each of the fine particle collecting duct 70 and the first duct 90 are ducts for guiding the air inside the apparatus body 12 to the outside of the apparatus body 12, are formed in a substantially cylindrical shape extending in the front-rear direction, and are arranged in parallel with each other. Each of the fine particle collecting duct 70 and first duct 90 is connected to an exhaust port (not shown) on the rear surface side of the apparatus body 12, and communicates with the outside of the apparatus body 12 via the exhaust port of the apparatus body 12. Further, although the details will be described later, the exhaust direction of the fine particle collecting duct 70 and the first duct 90 is set on the back surface side. Therefore, in the fine particle collecting duct 70 and the first duct 90, the front surface side is the upstream side of the flow of the air (air flow) and the back surface side is the downstream side of the air flow.

First, a configuration of the fine particle collecting duct 70 will be described. The fine particle collecting duct 70 is disposed above the fixing unit 44. Specifically, the fine particle collecting duct 70 is disposed above the first support member 442 supporting the heat roller 44*a* and the heat roller 44*a*.

The fine particle collecting duct 70 includes a fine particle collecting duct A portion 702 constituting the lower side of the fine particle collecting duct 70, a fine particle collecting duct B portion 704 constituting the upper side of the fine particle collecting duct 70, and the second sheet transport path L2 (sheet transport space after heat fixing) formed to be sandwiched between the fine particle collecting duct A portion 702 and the fine particle collecting duct B portion 704.

The fine particle collecting duct A portion 702 is partitioned by a first duct A forming member 72 and a separating member 80. The fine particle collecting duct A forming member 72 has a U-shaped cross section opened downward and is a member extending in the front-rear direction. The separating member 80 is a plate-like member extending in a substantially horizontal direction of the front and rear, and seals the lower side of the fine particle collecting duct A forming member 72. That is, the bottom surface of the fine particle collecting duct 70 is sealed by the separating member 80. Here, the separating member 80 is bent and has roughness formed therein.

The fine particle collecting duct B portion 704 is partitioned by a fine particle collecting duct B forming member 74 and a fine particle collecting duct B wall member 76. The fine particle collecting duct B forming member 74 is disposed above the fine particle collecting duct A forming member 72 with a predetermined space therebetween and has a U-shaped cross section opened upward and is a member extending in the front-rear direction. The fine particle collecting duct B wall member 76 is a plate-like member extending in a substantially horizontal direction of the front and rear, and seals the upper side of the fine particle collecting duct B forming member 74. That is, the top surface of the fine particle collecting duct 70 is sealed by the fine particle collecting duct B wall member 76.

Further, the above-described second sheet transport path L2 is configured to traverse the fine particle collecting duct 70 in the left and right direction. Specifically, the second sheet transport path L2 at the portion crossing the fine particle collecting duct 70 is formed of the top surface (top wall) of the fine particle collecting duct A forming member 72 and the bottom surface (bottom wall) of the fine particle collecting duct B forming member 74 disposed above the fine particle collecting duct A forming member 72.

As illustrated in FIG. 4, a plurality of communication ports 72*a* are formed on the top wall of the fine particle collecting duct A forming member 72, and a plurality of communication ports 74*a* are formed on the bottom wall of the fine particle collecting duct B forming member 74. Each of the plurality of communication ports 72*a* and each of the plurality of communication ports 74*a* are formed to line up in the front-rear direction along the air flow of the fine particle collecting duct 70. The fine particle collecting duct A portion 702, the second sheet transport path L2, and the fine particle collecting duct B portion 704 communicate with each other by the plurality of communication ports 72*a* and the plurality of communication ports 74*a*, and a series of spaces (ventilation path) is formed in the fine particle collecting duct 70.

However, as described above, the top surface and the bottom surface of the fine particle collecting duct 70 are sealed by the fine particle collecting duct B wall member 76 and the separating member 80. Therefore, the second sheet transport path L2 is separated from the internal space of the apparatus body 12 other than the fine particle collecting duct 70 except for the entrance and the exit thereof by the fine particle collecting duct 70.

Further, the separating member 80 is made of a material having high thermal conductivity. For example, the separating member 80 is formed of metallic materials. As the metallic material constituting the separating member 80, a cold rolled steel plate such as aluminum, an aluminum alloy, or SPCC, an electrogalvanized steel sheet such as SECC, a hot-dip galvanized steel sheet such as SGCC, and stainless steel such as SUS can be used.

Next, a configuration of the first duct 90 will be described. As illustrated in FIGS. 2 and 3, the first duct 90 is provided along a portion of the side surface (left side surface) of the top surface, and the bottom surface of the fixing unit 44 of the sheet ejecting tray 50. That is, the first duct 90 is provided so as to surround three sides of the fixing unit 44. Specifically, the first duct 90 is provided along a portion of the left side surface, the top surface, and the bottom surface of the heat roller 44*a* and the first support member 442 that supports the heat roller 44*a*.

The first duct 90 includes a first duct A portion (fixing side surface duct portion) 902 that covers the left side surface and the bottom surface of the fixing unit 44 (the first support member 442) and a first duct B portion (fixing top surface duct portion) 904 that covers the top surface of the fixing unit 44 (the first support member 442).

The first duct A portion 902 is partitioned by a first duct A forming member 92. The first duct A forming member 92 includes a vertically elongated portion which forms a space extending in the vertical direction along the left side surface of the fixing unit 44 (the first support member 442), a lower end portion which is connected to the lower end of the vertically elongated portion and forms a space extending to the fixing unit 44 side (the first sheet transport path L1 side) along the bottom surface of the fixing unit 44 (first support member 442). A space (ventilation path) having a substantially L-shaped cross section which is partitioned by the vertically elongated portion and the lower end portion of the first duct A forming member 92 is formed in the first duct A portion 902.

Further, a process unit 64 is disposed below the first duct A portion 902 (the lower end portion of the first duct A forming member 92). That is, a portion of the first duct A portion 902 (the lower end portion of the first duct A forming member 92) is provided so as to enter the gap between the fixing unit 44 and the process unit 64.

The first duct B portion 904 is partitioned by the first duct B forming member 94 and the separating member 80. The first duct B forming member 94 is a member which is provided adjacent to the upper side of the first duct A forming member 92, has a U-shaped cross section opened toward the upper side, and extends to in the front-rear direction along the top surface of the fixing unit 44 (the first support member 442). However, in a case of being viewed from the front-rear direction, the first duct B forming member 94 is provided so as to have a flat shape in which the vertical direction is short and the horizontal direction is long, enter the gap between the bottom surface of the fine particle collecting duct 70 and the fixing unit 44, and cover the top surface of the fixing unit 44 (top wall of the first support member 442). Further, the upper side of the first duct B forming member 94 is sealed by the separating member 80. That is, the top surface of the first duct 90 is sealed by the separating member 80.

As described above, the separating member 80 seals the lower surface of the fine particle collecting duct 70 and seals the top surface of the first duct 90. That is, the fine particle collecting duct 70 and the first duct 90 are provided so as to be adjacent to each other with the separating member 80 interposed therebetween. Also, it can be said that the first duct B portion 904 is formed between the fine particle collecting duct 70 and the fixing unit 44.

Here, the lower surface (a side wall on a fixing unit side of first duct B portion 904) of the first duct B forming member 94 is formed of the material with heat resistance. To be heat resistant means that the heat resistant temperature exceeds 100 degrees. Further, the lower surface of the first duct B forming member 94 may have the heat resistance equivalent to or more than that of the fixing temperature. For example, as the material constituting the lower surface of the first duct B forming member 94, in addition to a general heat-resistant resin such as polyether sulfone (PES), polyphenylene sulfide (PPS), liquid crystal polymer (LCP), polyether nitrile (PEN), polyimide (PI), polyamide imide (PAI), polyether ether ketone (PEEK) and polyethylene terephthalate (PET), composite materials formed of these resins and glass fiber, metal, ceramics, and the like can be used. Note that the entirety of the first duct B forming member 94 may be made of a material with heat resistance.

In addition, as illustrated in FIGS. 4 and 5, the first communication port 96 and the second communication port 98 communicating with the first duct A portion 902 and the first duct B portion 904 are formed in the first duct 90. Each of the first communication port 96 and the second communication port 98 is formed by a communication hole formed in a portion of the lower surface of the first duct A forming member 92 and a portion of the lower surface of the first duct B forming member 94. The first communication port 96 is positioned on the upstream side (front surface side) of the air flow in the first duct 90. Further, the second communication port 98 is positioned on the downstream side (rear surface side) of the air flow in the first duct 90. The first communication port 96 and the second communication port 98 are formed at positions separated from each other (in the front-rear direction) along the air flow, and a separation wall 906 for separating the first duct A portion 902 and the first duct B portion 904 is formed between the first communication port 96 and the second communication port 98. That is, an internal flow path of the first duct 90 is divided into a plurality of air flow paths.

Further, as illustrated in FIGS. 2 to 5, a plurality of intake ports 92*a* through which the air in the internal space of the apparatus body 12 other than the fine particle collecting duct 70 passes are formed in the first duct 90. The plurality of intake ports 92*a* are formed in the bottom wall of the first duct A forming member 92. As illustrated in FIGS. 2 and 3, the plurality of intake ports 92*a* are formed at the end portion on the right side (the fixing unit 44 side or the first sheet transport path L1 side) of the bottom wall of the first duct A forming member 92. That is, the plurality of intake ports 92*a* are formed in a part where the first duct 90 covers the lower side of the fixing unit 44. Further, a plurality of intake ports 92*a* are formed on the upstream side from the fixing unit 44 in the sheet transport direction. That is, the plurality of intake ports 92*a* are formed below the fixing unit 44.

The plurality of intake ports 92*a* are formed in the vicinity of the top surface of the process unit 64 and open toward the process unit 64. Therefore, the plurality of intake ports 92*a* are provided so as to suck the air at the side surface portion of the process unit 64 on the side of the fixing unit 44. The lower end portion of the right side wall of the first duct 90 and the top wall of the process unit 64 are disposed without any gap therebetween so that the air in the space on the first sheet transport path L1 side is not suctioned into the plurality of intake ports 92*a*.

As illustrated in FIGS. 4 and 5, the plurality of intake ports 92*a* are arranged at a predetermined interval in the front-rear direction along the air flow of the first duct 90. Here, at least one of the plurality of air intake ports 92*a* is positioned on the upstream side (front surface side) of the air flow from the end portion on the upstream side (front surface side) of the air flow of the separation wall 906. Further, the plurality of intake ports 92*a* may be formed by arranging a plurality of ribs opposed to one opening.

As described above, the fine particle collecting duct 70 and the first duct 90 are formed. In addition, as illustrated in FIG. 4, the fine particle collecting duct 70 is provided with a fine particle collecting duct exhaust fan 82 and a filter 84. The fine particle collecting duct exhaust fan 82 is disposed at the end portion on the rear surface side (downstream side of the air flow) of the fine particle collecting duct 70, and the filter 84 is disposed on the rear surface side (downstream side of the air flow) of the fine particle collecting duct exhaust fan 82. As illustrated in FIGS. 4 and 5, a first exhaust fan (exhaust fan) 86 is provided in the first duct 90. The first exhaust fan 86 is disposed at the end portion on the rear surface side (downstream side of the air flow) of the first duct 90.

The fine particle collecting duct exhaust fan 82 and the first exhaust fan 86 are axial flow fans, for example, propeller fans. The fine particle collecting duct exhaust fan 82 and the exhaust direction of the first exhaust fan 86 are set on the rear surface side. Therefore, the fine particle collecting duct exhaust fan 82 suctions the air inside the fine particle collecting duct 70 and sends the suctioned air to the rear surface side (the outside of the apparatus body 12). Further, the first exhaust fan 86 suctions the air inside the first duct 90 and sends the suctioned air to the outside of the apparatus body 12. The fine particle collecting duct exhaust fan 82 and the first exhaust fan 86 are controlled by the control unit of the image forming apparatus 100 and are operated and stopped in accordance with instructions from the control unit.

The filter 84 is a UFP collection filter for collecting ultrafine particles (UFP) by heating a sheet or toner by using the fixing unit 44.

In addition to the UFP collection filter, the filter 84 may include a VOC collection filter for collecting volatile organic compounds (VOC) or ozone.

Next, the flow of the air in the exhaust unit 10 of the first embodiment will be described. First, the flow of the air in the fine particle collecting duct 70 will be described. As illustrated in FIG. 4, in the fine particle collecting duct 70, when the fine particle collecting duct exhaust fan 82 operates, the air in the fine particle collecting duct A portion 702, the second sheet transport path L2, and the fine particle collecting duct B portion 704 is suctioned into the fine particle collecting duct exhaust fan 82.

In this way, in the fine particle collecting duct 70, the air in a space (the second sheet transport path L2) in which the sheet is transported and the air in a space (the fine particle collecting duct A portion 702 and the fine particle collecting duct B portion 704) on the upper and lower sides thereof passed through the filter 84 and guided to the outside of the apparatus body 12. That is, the fine particle collecting duct 70 functions as a duct for collecting substances such as UFPs.

Next, the flow of the air in the first duct 90 will be described. As illustrated in FIGS. 4 and 5, in the first duct 90, when the first exhaust fan 86 is operated, the air in the first duct A portion 902 is suctioned into the first exhaust fan 86. Further, the air flows into the first duct A portion 902 from the plurality of intake ports 92*a*. At this time, a part of the air flowing into the first duct A portion 902 from the intake port 92*a* positioned on the upstream side (front surface side) of the air flow from the separation wall 906 separating the first duct A portion 902 and the first duct B portion 904 moves upward through the first communication port 96 and flows into the first duct B portion 904, flows through the first duct B portion 904 toward the rear surface side, passes through the second communication port 98, and then flows into the first duct A portion 902 again.

In the first embodiment, the first duct 90 includes the first duct A portion 902 along a portion of the left side surface and the bottom surface of the fixing unit 44 and the first duct B portion 904 along the top surface of the fixing unit 44. In this way, by dividing the duct for each surface facing the fixing unit 44, it is possible to restrain unevenness in the flow of air in each of the first duct A portion 902 and the first duct B portion 904 so as to secure an air flow rate. Therefore, in the first duct 90, it is possible to interrupt the heat of the fixing unit 44 directed to the left side of the lower side due to the air flowing through the first duct A portion 902, and to interrupt the heat of the fixing unit 44 directed to the upper side due to the air flowing through the first duct B portion 904. That is, it is possible to effectively interrupt the heat of the fixing unit 44 without unevenness.

In particular, in the image forming apparatus 100 having the above-described configuration, the top surface of the first support member 442 supporting the heat roller 44*a* is heated to a high temperature. In the first embodiment, since the heat of the fixing unit 44 directed to the upper side is interrupted due to the air flowing through the first duct B portion 904, it is possible to restrain the fine particle collecting duct 70 (the second sheet transport path L2) from being directly exposed to the heat of the fixing unit 44. Therefore, the temperature rise inside the fine particle collecting duct 70 can be suppressed.

Further, in the first embodiment, the first duct 90 is provided with the separation wall 906 for separating the first duct A portion 902 and the first duct B portion 904, so that the air flowing from the intake port 92*a* flows through the first duct B portion 904. Therefore, it is possible to secure the flow rate of the air flowing through the first duct B portion 904, thereby securing a heat insulating effect on the top surface side of the fixing unit 44.

Furthermore, in the first example, the first duct B forming member 94 (the bottom wall of the first duct B portion 904) facing the top surface of the first support member 442 is formed of a material with heat resistance. Thus, the heat resistance of the first duct B portion 904 can be secured.

Further, if the heat of the fixing unit 44 is transferred to the process unit 64, there is a problem that the temperature of the inside of the process unit 64 becomes higher, the toner between the cleaning blade of the cleaner unit 38 and the photosensitive drum 36 is melted, and thereby a cleaning failure occurs in which toner remains on the surface of the photosensitive drum 36. In the first embodiment, a portion of the first duct A portion 902 is formed between the fixing unit 44 and the process unit 64, and thus it is possible to interrupt the heat of the fixing unit 44 directed to the lower side by the first duct A portion 902, and to restrain the process unit 64 from being directly exposed to the heat of the fixing unit 44.

Furthermore, since the plurality of intake ports 92*a* are provided such that the air around the process unit 64 passes through, the top surface of the process unit 64 is cooled by the air suctioned into the plurality of intake ports 92*a*. Therefore, it is possible to suppress the temperature rise in the process unit 64 and to restrain the above-described cleaning failure.

Further, the fine particle collecting duct 70 is provided with a high-density filter 84 for collecting the substances such as UFPs. Since this filter 84 has a large air flow resistance, the flow velocity of the air flow passing through the filter 84 is decreased, and the flow rate of the air discharged to the outside of the apparatus body 12 from the fine particle collecting duct 70 is decreased. That is, the fine particle collecting duct 70 has a capacity of collecting the substances such as UFPs, but there is a problem in that a cooling capacity is deteriorated, and the temperature of the inside of the fine particle collecting duct 70 becomes higher due to the heated and fixed sheet. On the other hand, since no filter is provided in the first duct 90, the flow rate of the air discharged from the first duct 90 to the outside of the apparatus body 12 can be secured. Here, the fine particle collecting duct 70 and the first duct 90 are provided so as to be adjacent to each other with a separating member 80 formed of a material with high thermal conductivity. That is, the fine particle collecting duct 70 and the first duct 90 are indirectly thermally coupled (thermally coupled) via the separating member 80, and the heat can be mutually transferred between the fine particle collecting duct 70 and the first duct 90. Therefore, by transferring the heat inside the fine particle collecting duct 70 to the air flowing through the first duct 90 via the separating member 80 and discharging the air to the outside of the apparatus body 12, it is possible to suppress the internal temperature of the fine particle collecting duct 70 from becoming higher. That is, the heat of the fine particle collecting duct 70 can be dissipated to the first duct 90 to compensate for lowering a cooling capacity of the fine particle collecting duct 70. In addition, since the separating member 80 has roughness formed, a surface area of the separating member 80 is increased, and the heat radiation effect of the fine particle collecting duct 70 can be enhanced.

As described above, the first duct 90 has the heat insulating effect of insulating the heat of the fixing unit 44 so as not to be transferred to other components of the image forming apparatus 100, and a cooling effect of suppressing an increase in the internal temperature of the image forming apparatus 100. Here, since the intake port 92*a* of the first duct 90 is formed on the upstream side from the fixing unit 44 in the sheet transport direction, air having a relatively low temperature can be taken in the inside of the first duct 90. Therefore, the above-described heat insulating effect and cooling effect can be efficiently obtained. Further, since the substances such as UFPs are not generated on the upstream side from the fixing unit 44 in the sheet transport direction, the substances such as UFP do not flow into the first duct 90 and are not discharged to the outside of the apparatus body 12.

Second Embodiment

Since an image forming apparatus 100 of a second embodiment is the same as the image forming apparatus 100 of the first embodiment except that it further includes an air blowing unit 110 that sends auxiliary air to the fine particle collecting duct 70 and the first duct 90, contents different from those of the first embodiment will be described, and redundant explanation will not be made.

Figure 6:
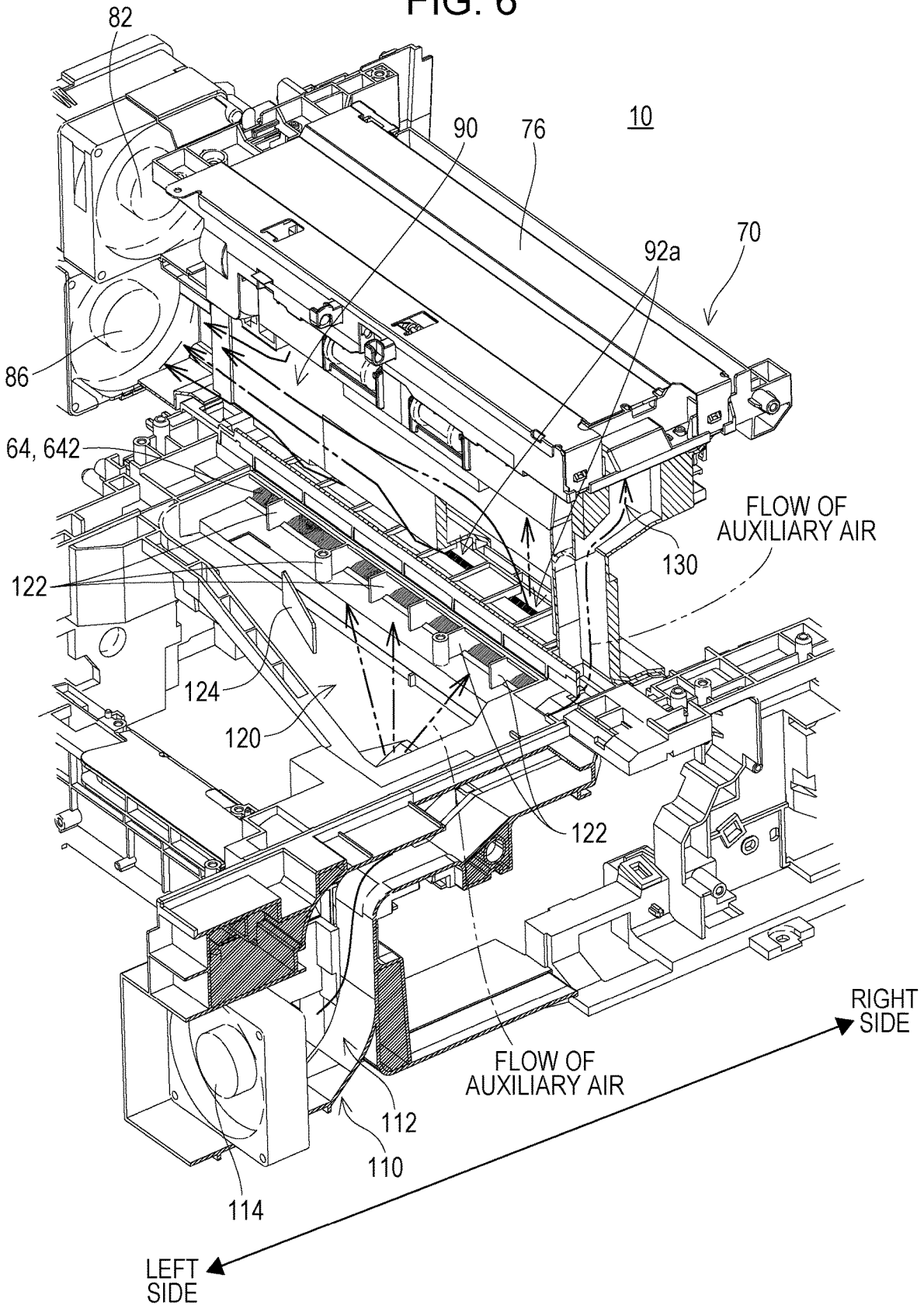
FIG. 6 is a schematic sectional view illustrating structures of an air supply unit and an exhaust unit of a second embodiment.
Figure 7:
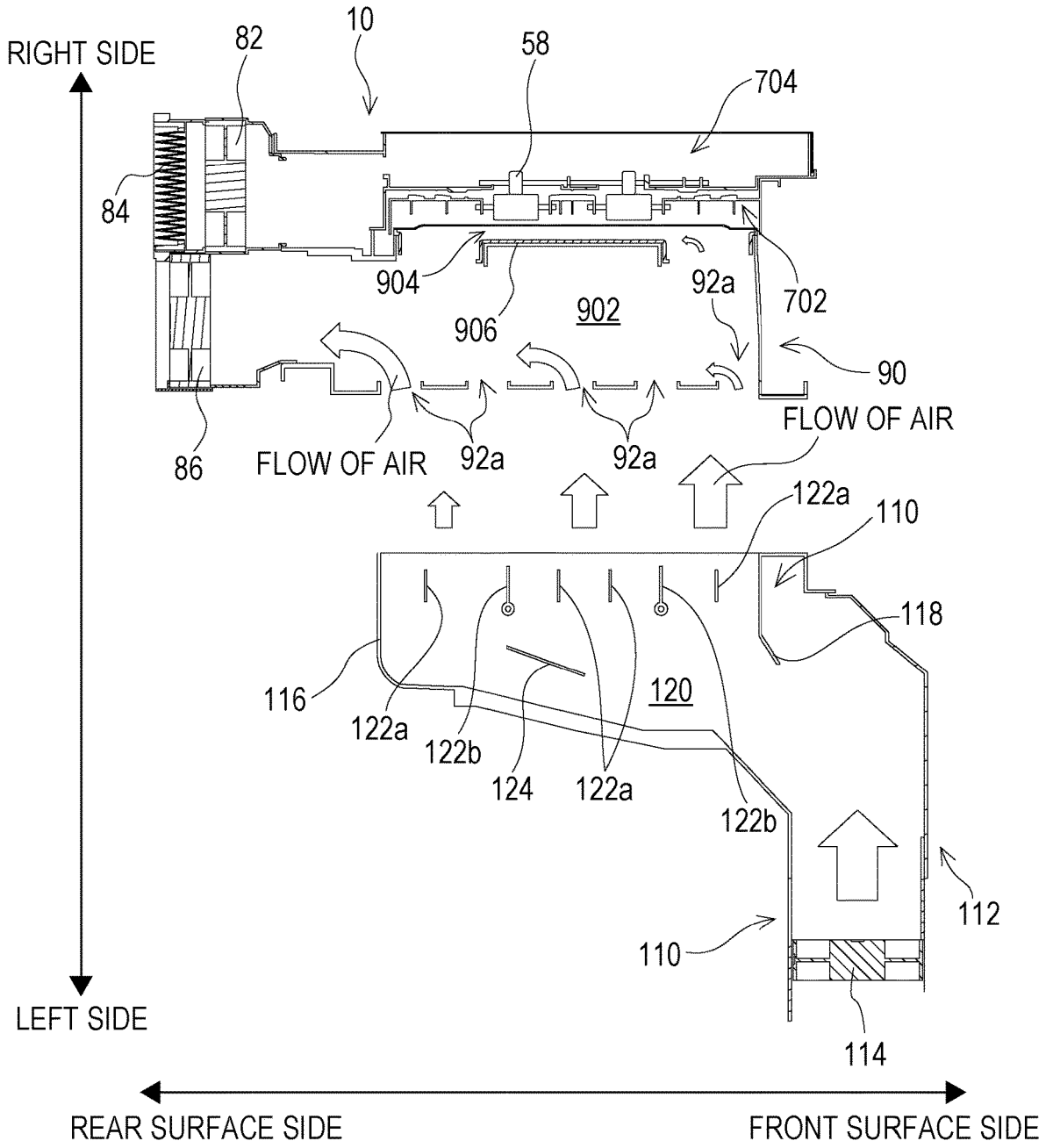
FIG. 7 is a schematic view illustrating the flow of air in a case where the first duct and the second duct of the second embodiment are not connected to each other.
Figure 8:
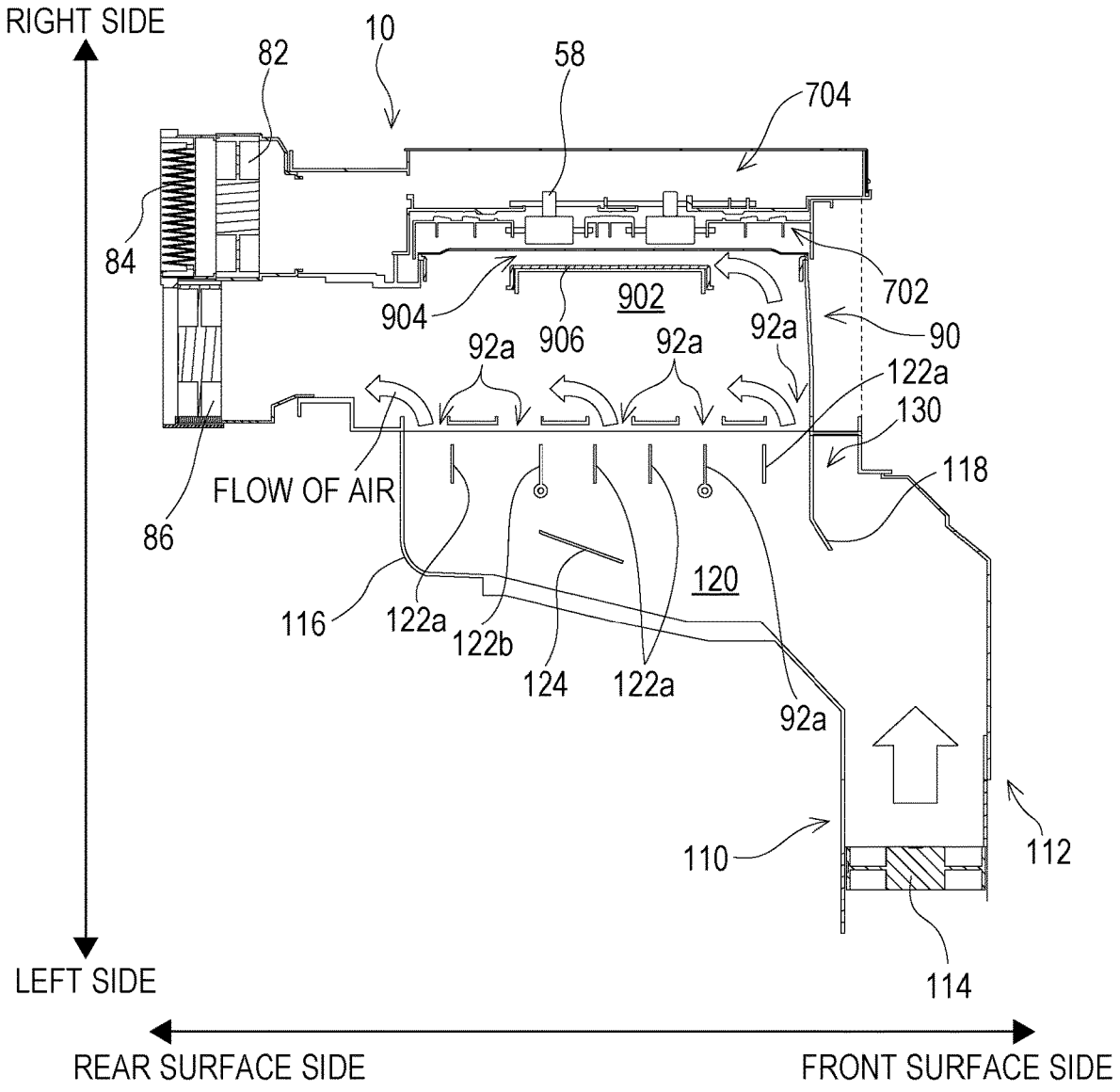
FIG. 8 is a schematic view illustrating the flow of air in a case where the first duct and the second duct of the second embodiment are connected to each other.

FIG. 6 is a schematic sectional view illustrating structures of the air blowing unit 110 and the exhaust unit 10 of the second example. FIG. 7 is a schematic view illustrating the flow of air in a case where the first duct 90 and the second duct 112 of the second embodiment are not connected to each other. FIG. 8 is a schematic view illustrating the flow of air in a case where the first duct 90 and the second duct 112 of the second embodiment are connected to each other.

As illustrated in FIG. 6, the air blowing unit (air blowing device) 110 includes a second duct 112. The second duct 112 is a duct which is formed of a second duct forming member 116 and guides air (fresh air) outside the apparatus body 12 to the fine particle collecting duct 70 and the first duct 90. One end portion of the second duct 112 is connected to a ventilation portion (not shown) provided at the front surface side end portion on the left side surface of the apparatus body 12, and communicates with the outside of the apparatus body 12 via the ventilation portion of the apparatus body 12.

An intake fan 114 is provided on the downstream side of the ventilation portion of the apparatus body 12 in the second duct 112. The intake fan 114 is an axial flow fan, for example, a propeller fan. Further, the exhaust direction of the intake fan 114 is set to the right side. Therefore, the air intake fan 114 suctions the air outside the apparatus body 12 from the ventilation portion and sends the suctioned air from to the inside of the second duct 112. The intake fan 114 is controlled by the control unit of the image forming apparatus 100 and is operated and stopped in accordance with instructions from the control unit.

Further, as illustrated in FIGS. 7 and 8, the second duct 112 is branched (separated) to the second duct A portion (duct enlarged portion) 120 and the second duct B portion 130 by the separation wall 118 on the downstream side of the air flow from the intake fan 114. An end portion of the second duct A portion 120 on the downstream side communicates with the first duct 90, and an end portion of the second duct B portion 130 on the downstream side communicates with the fine particle collecting duct 70. Therefore, the air sent to the inside of the second duct 112 by the intake fan 114 is sent to the first duct 90 through the second duct A portion 120, and is sent (supplied) to the fine particle collecting duct 70 through the second duct B portion 130.

The second duct B portion 130 communicates with the end portion on the front surface side of the fine particle collecting duct 70 by extending the right surface side to the front surface side in the apparatus body 12. As illustrated in FIG. 6, an inflow port communicating with the second duct B portion 130 is formed at an end portion on the front surface side of the in the fine particle collecting duct 70. Therefore, the air sent by the intake fan 114 flows into the fine particle collecting duct 70 from the inflow port.

The second duct A portion 120 is formed such that inside the apparatus body 12 (below the sheet ejecting tray 50) extends to the right side and the flow path expands toward the front-rear direction as going to the right side (communication portion with the first duct 90). The end portion of the second duct A portion 120 on the downstream side enters the lower side of the first duct 90 and communicates with the first duct 90 via the plurality of intake ports 92*a*. Here, the end portion of the second duct A portion 120 on the downstream side is formed so as to include all of the intake ports 92*a* of the first duct 90 in the front-rear direction. Therefore, the air sent by the intake fan 114 flows into the first duct 90 from each of the intake ports 92*a*. That is, a series of ducts (ventilation paths) constituted by the second duct 112 (the second duct A portion 120) and the first duct 90 has a push-pull structure in which the intake fan 114 and the first exhaust fan 86 are arranged in series. Thus, it is possible to sufficiently secure the flow rate of air passing through each of the intake ports 92*a*.

In addition, the second duct A portion 120 is provided with a plurality of shunt flow rectifying ribs (rectifying plate) 122 and a shunt rib (shunt plate) 124. The plurality of shunt flow rectifying ribs 122 are arranged at the end portion of the second duct A portion 120 on the downstream side, that is, connection portions of the plurality of first ducts 90. Each of the plurality of shunt flow rectifying ribs 122 is a plate-shaped rib extending in the horizontal direction, and is provided substantially in parallel with a predetermined space therebetween. The air flowing through the second duct A portion 120 flows radially from the right side to the rear surface side on the upstream side from the plurality of flow dividing and rectifying ribs 122 as illustrated in FIG. 6, and the direction (direction perpendicular to the direction of the air flow in the first duct 90) is changed to the right by each of the plurality of shunt flow rectifying ribs 122, and is guided to the plurality of intake ports 92*a*.

Here, the shunt flow rectifying rib 122 includes a rectifying rib A (rectifying plate) 122*a* and a rectifying rib B (rectifying plate) 122*b*. The rectifying rib B122*b* is set to be long on the upstream side from the rectifying rib A122*a*. Thus, in the rectifying rib B122*b*, the air can flow more than that in the rectifying rib A122*a*. Therefore, by disposing the rectifying rib B122*b* at a predetermined position, it is possible to increase the flow rate of the air passing through the intake port 92*a* far from the first exhaust fan 86. For example, the second and fifth shunt flow rectifying ribs 122 from the front surface side (the side closer to the intake fan 114) are constituted by the rectifying rib B122*b*, and the other shunt flow rectifying rib 122 is constituted by the rectifying rib A122*a*.

Further, the shunt rib 124 is disposed at a position which is the upstream side of the air flow from the shunt flow rectifying rib 122 and in which the flow path of the second duct A portion 120 expands. This shunt rib 124 sends air to the shunt flow rectifying rib 122 disposed at a position far from the intake fan 114 among the plurality of shunt flow rectifying ribs 122 so that the air flows in a balanced manner to each of the plurality of intake ports 92*a*.

As illustrated in FIGS. 6 and 8, the plurality of intake ports 92*a* are arranged such that distances to the first exhaust fan 86 are different from each other. In addition, the plurality of intake ports 92*a* are arranged such that distances to the intake fan 114 are different from each other.

Therefore, as illustrated in FIG. 7, in the first duct 90, among the plurality of intake ports 92*a*, the intake port 92*a* having a short distance to the first exhaust fan 86 (close to the first exhaust fan 86) and the intake port 92*a* having a long distance to the first exhaust fan 86 (far from the first exhaust fan 86) have different duct resistance (pipe friction loss), and the air flow rate (intake air amount) suctioned by the first exhaust fan 86 becomes ununiform. For this reason, although the air flow rate can be secured at the intake port 92*a* on the rear surface side close to the first exhaust fan 86, the air flow rate is decreased at the intake port 92*a* on the front surface side far from the first exhaust fan 86. Particularly, when the air flow rate of the intake port 92*a* on the front surface side is decreased, the amount of air flowing into the first duct B portion 904 is decreased, and the heat insulating property of the first duct B portion 904 is deteriorated.

In addition, in the second duct 112, since the distances to the intake fan 114 are different on the front surface side and the rear surface side at end portion (communication portion with the first duct 90) of the second duct 112 on the downstream side, a difference in the duct resistance occurs, so that the air flow rate (the amount of air guided to each of the intake ports 92*a*) sent by the intake fan 114 becomes ununiform. For this reason, although the flow rate of the air guided to the intake port 92*a* on the front surface side close to the intake fan 114 can be secured, the flow rate of the air guided to the intake port 92*a* on the rear surface side far from the intake fan 114 is decreased.

In this way, in the intake port 92*a* on the rear surface side, the flow rate of air sent by the intake fan 114 is small while the flow rate of air suctioned by the first exhaust fan 86 is large. On the other hand, in the intake port 92*a* on the front surface side, the flow rate of air sent by the intake fan 114 is large while the flow rate of air suctioned by the first exhaust fan 86 is small.

As illustrated in FIG. 8, by connecting the first duct 90 having such characteristics and the second duct 112 to each other, a total air flow rate of the flow rate of air suctioned by the first exhaust fan 86 and the flow rate sent by the intake fan 114 can be made uniform in each intake port 92*a*. That is, it is possible to make the flow rate of air passing through each of the intake ports 92*a* uniform.

In addition, in the second embodiment, with the plurality of the shunt flow rectifying rib 122, it is possible to increase the flow rate of the air passing through the intake port 92*a* far from the first exhaust fan 86. Thus, it is possible to compensate for the decrease in the flow rate of air passing through the intake port 92*a* far from the first exhaust fan 86 due to the difference in duct resistance so as to make the flow rate of air passing through each intake port 92*a* uniform.

Third Embodiment

Since an image forming apparatus 100 of a third embodiment is the same as the image forming apparatus 100 of the second embodiment except that the first duct 90 and the second duct 112 are connected to each other by a portion of the process unit 64, contents different from those of the second embodiment will be described, and redundant explanation will not be made.

Figure 9:
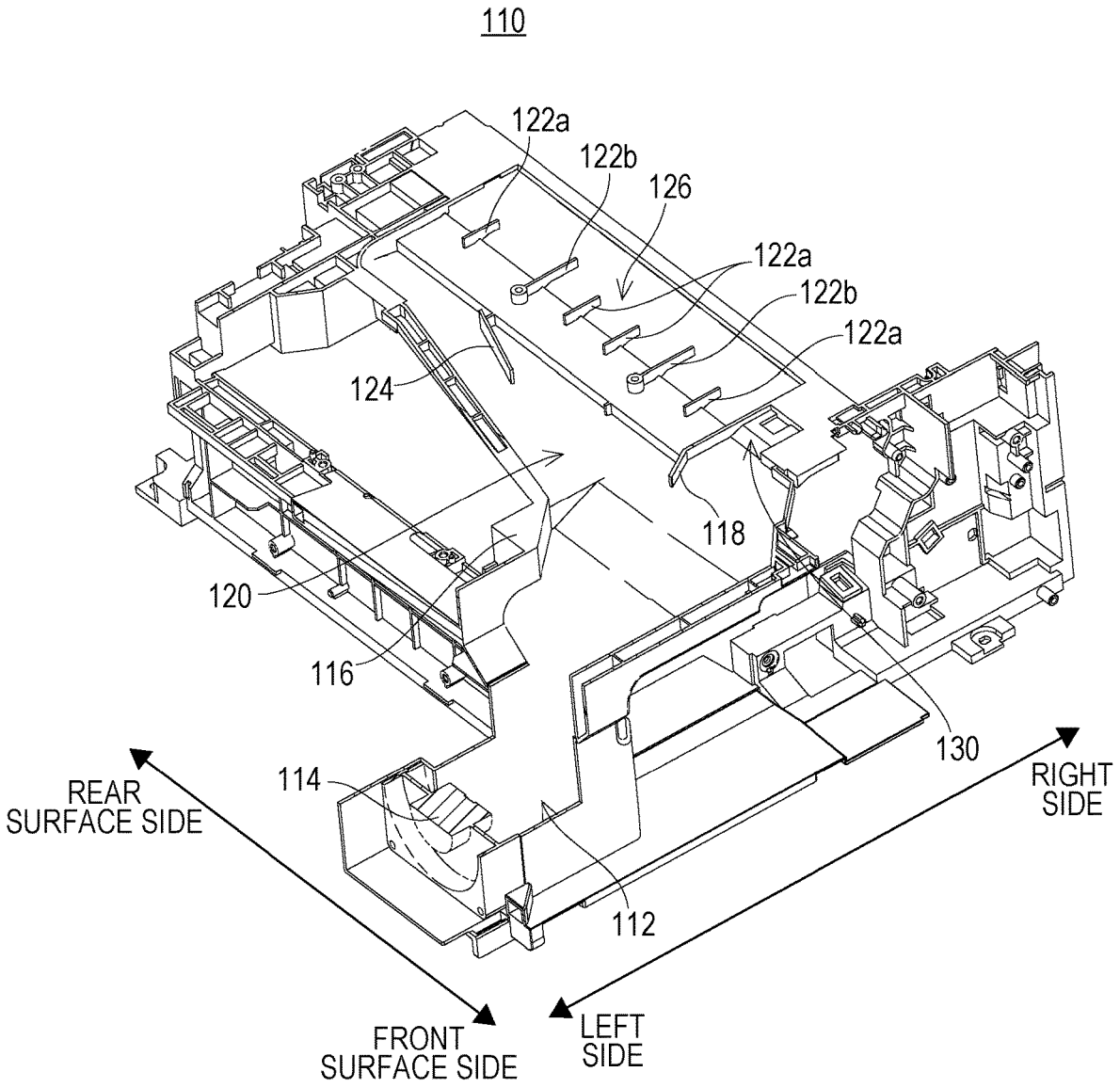
FIG. 9 is a schematic perspective view illustrating a structure of the second duct of a third embodiment.
Figure 10:
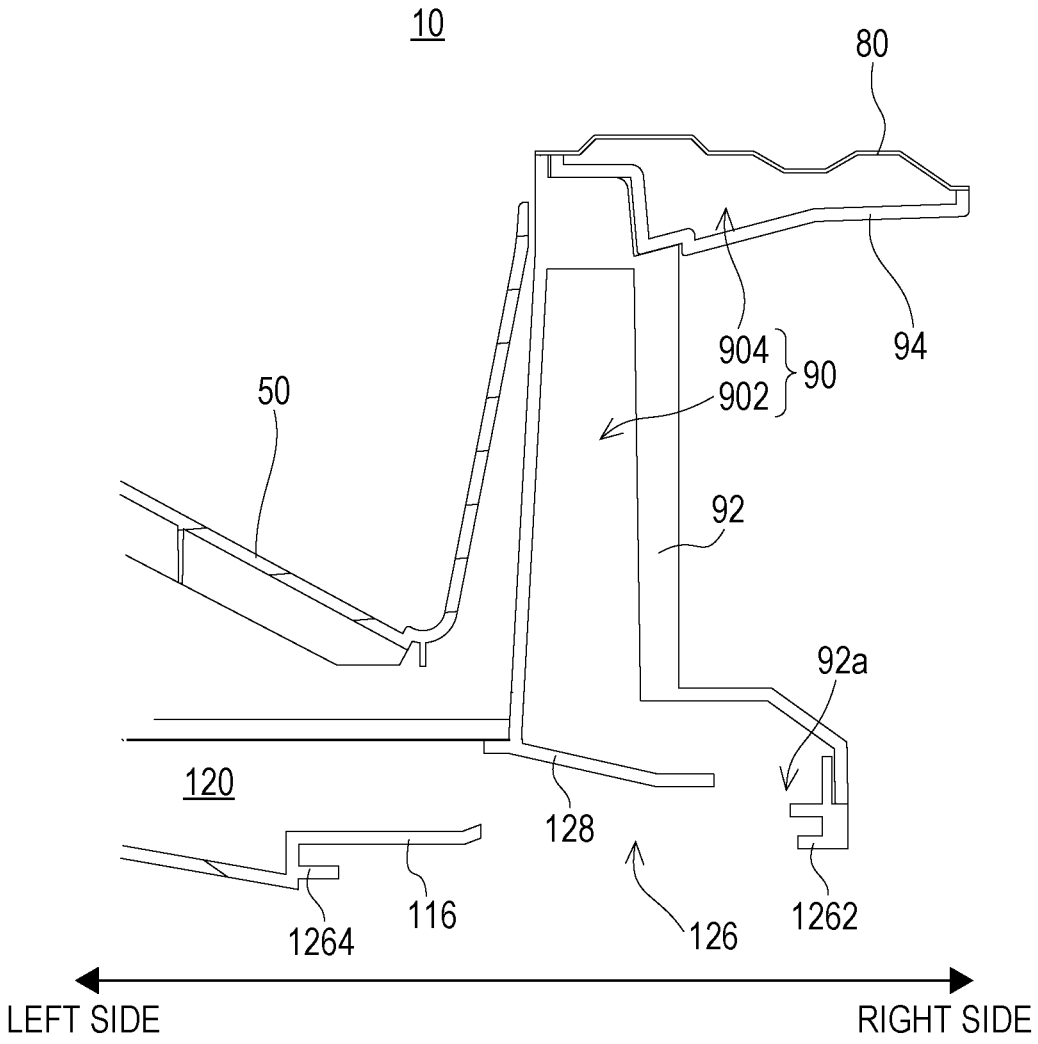
FIG. 10 is a schematic sectional view illustrating structures of the first duct and the second duct before the process unit is inserted, in the third embodiment.
Figure 11A:
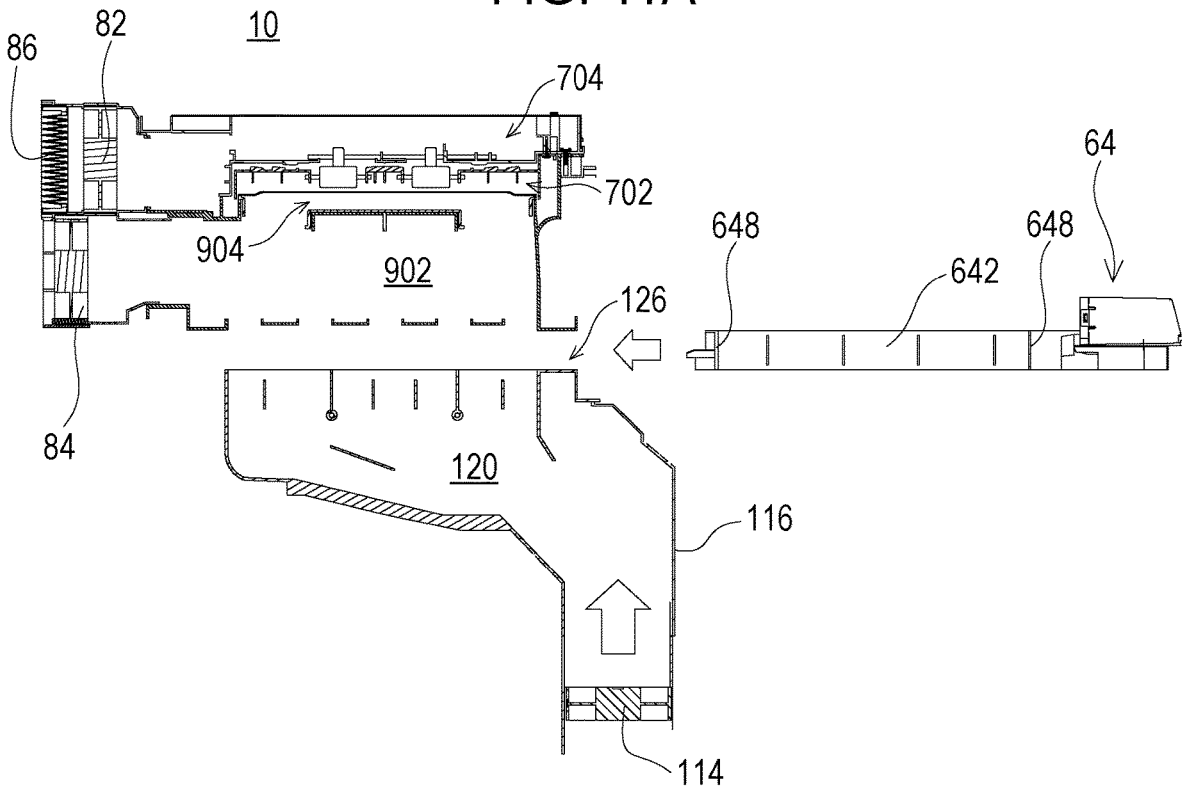
FIG. 11A is a schematic view illustrating the structures of the first duct and the second duct before the process unit is inserted, in the third embodiment.
Figure 11B:
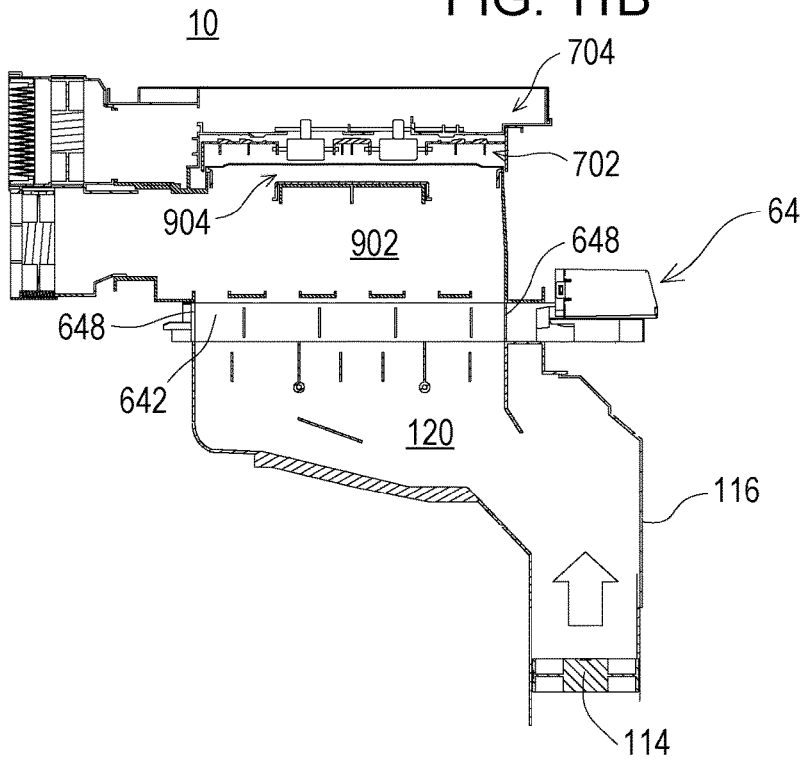
FIG. 11B is a schematic view illustrating the structures of the first duct and the second duct after the process unit is inserted, in the third embodiment.
Figure 12:
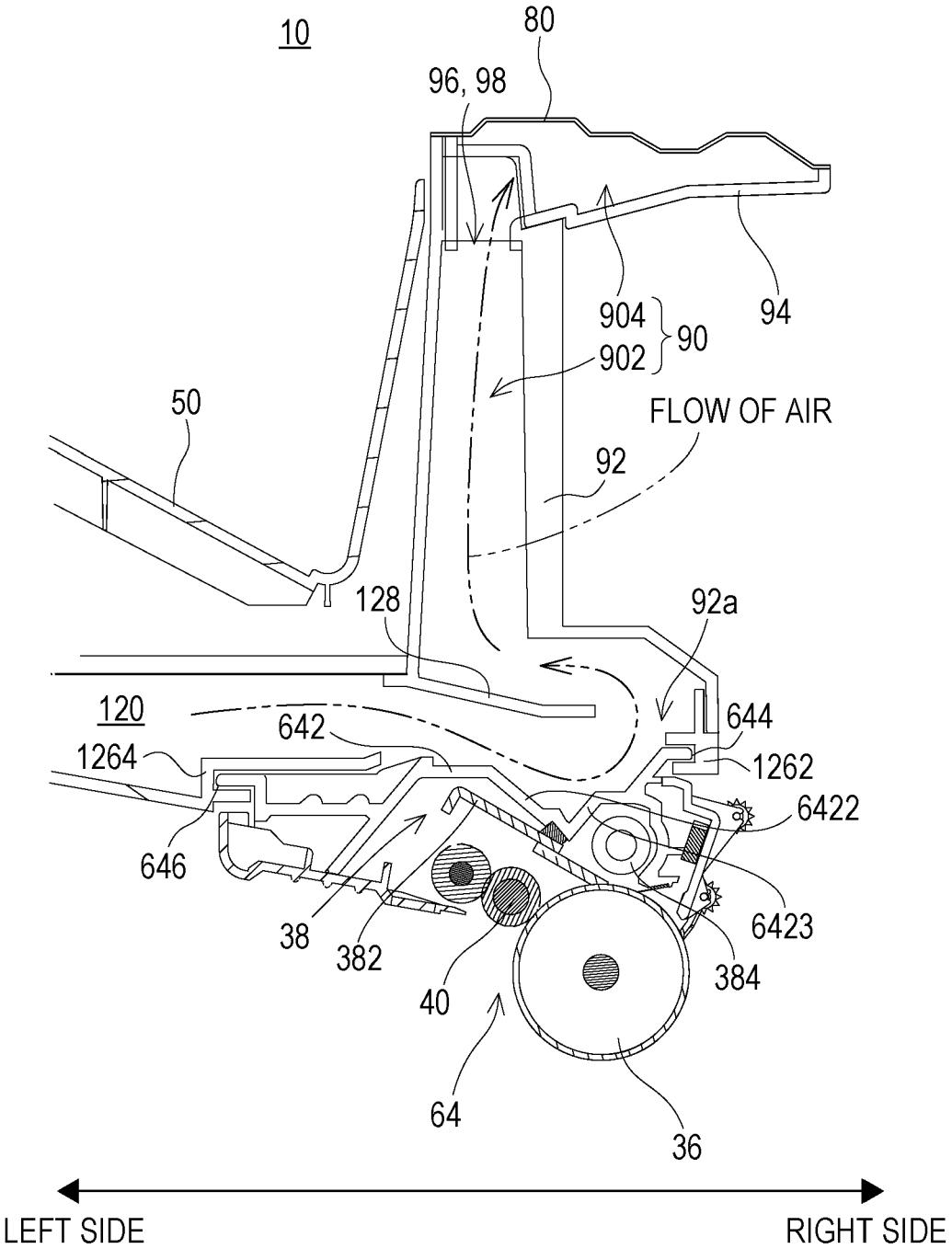
FIG. 12 is a schematic sectional view illustrating the structures of the first duct and the second duct after the process unit is inserted, in the third embodiment.

FIG. 9 is a schematic perspective view illustrating a structure of the second duct 112 of the third embodiment. FIG. 10 is a schematic sectional view illustrating structures of the first duct 90 and the second duct 112 before the process unit 64 is inserted, in the third embodiment. FIG. 11A is a schematic view illustrating the structures of the first duct 90 and the second duct 112 before the process unit 64 is inserted, in the third embodiment. FIG. 11B is a schematic view illustrating the structures of the first duct 90 and the second duct 112 after the process unit 64 is inserted, in the third embodiment. FIG. 12 is a schematic sectional view illustrating the structures of the first duct 90 and the second duct 112 after the process unit 64 is inserted, in the third embodiment. Note that, FIGS. 8 and 11 are illustrated as engaging on one plane in order to explain a state of engagement between the first duct and the second duct in an easy-to-understand manner; however, in actuality, the first duct is installed and engaged at an angle in a direction perpendicular to the sheet surface.

As illustrated in FIGS. 9 and 10, in the third embodiment, a gap (opening) 126 is formed in a space (communication portion) between the first duct 90 and the second duct 112. The gap 126 is formed by an opening formed in the second duct forming member 116. In addition, the gap 126 is formed over the entire front-rear direction at the end portion of the second duct A portion 120 on the downstream side. Further, as illustrated in FIG. 10, the gap 126 is formed below the first duct 90, and faces the plurality of intake ports 92*a* and the bottom wall of the first duct 90 (first duct B portion 904).

In addition, as illustrated in FIGS. 11A and 11B, the process unit 64 is provided so as to be removable in the front-rear direction. The process unit 64 is inserted to the rear surface side from the front surface side below the gap 126, and is mounted on the apparatus body 12. As illustrated in FIG. 11A, the gap 126 is open before the process unit 64 is mounted on the main body 12. On the other hand, as illustrated in FIG. 11B, in a state where the process unit 64 is mounted on the apparatus body 12, the process unit is disposed at a position adjacent to the communication portion, and a top wall (facing wall portion) 642 of the process unit 64 is configured to seal the gap 126. That is, the top wall 642 of the process unit 64 is formed on the wall surface of the communication portion, and the first duct 90 and the second duct 112 are connected to each other by the top wall 642 of the process unit 64.

Further, two ribs 648 extending in the horizontal direction are formed on the top wall 642 of the process unit 64. One of the two ribs 648 is formed on the front surface side of the top wall 642 such that the front wall of the end portion of the first duct 90 (first duct A portion 902) on the upstream side, and the front wall of the end portion of the second duct 112 (second duct A portion 120) on the downstream side are connected to each other without any gap. The other one of the two ribs 648 is formed on the rear surface side of the top wall 642 such that the rear wall of the end portion of the first duct 90 on the upstream side and the rear wall of the end portion of the second duct 112 on the downstream side. With these two ribs 648, the air is restrained from leaking to the front surface side and the rear surface side. The two ribs 648 may be wall-shaped.

In addition, as illustrated in FIG. 12, an engagement piece 644 is formed at one end portion (end portion on the downstream side (right side) of the air flow) of the top wall 642 of the process unit 64, and an engagement piece 646 is formed at the other end portion (end portion on the upstream side (left side) of the air flow). Each of the engagement piece 644 and the engagement piece 646 is a portion of the top wall 642, and the engagement piece 644 is formed into a plate shape extending toward the downstream side of the air flow, and the engagement piece 646 is formed into a plate shape extending toward the upstream side of the air flow. In addition, each of the engagement piece 644 and the engagement piece 646 is formed across at least two ribs 648 in the front-rear direction of the process unit 64.

Further, an engaging portion 1262 engaging with the engagement piece 644 is formed at the end portion of an opening end constituting the gap 126 on the downstream side of the air flow, and an engaging portion 1264 engaging with the engagement piece 646 is formed at the end portion of an opening end constituting the gap 126 on the upstream side of the air flow. The engaging portion 1262 has a U-shaped cross section opened toward upstream of the air flow, and the engaging portion 1264 has a U-shaped cross section opened toward downstream of the air flow. Each of the engaging portion 1262 and the engaging portion 1264 extends in the front-rear direction. In the state where the process unit 64 is mounted on the apparatus body 12, the engagement piece 644 and the engaging portion 1262 are engaged with each other, and the engagement piece 646 and the engaging portion 1264 are engaged with each other. That is, when the engagement piece 644 and the engaging portion 1262 are engaged with each other, and the engagement piece 646 and the engaging portion 1264 are engaged with each other, the air is restrained from leaking from the gap 126.

Here, the engagement piece 644 is slidable with respect to the engaging portion 1262, and the engagement piece 646 is slidable with respect to the engaging portion 1264. Therefore, in the state where the engagement piece 644 and the engaging portion 1262 are engaged with each other, and the engagement piece 646 and the engaging portion 1264 are engaged with each other, the process unit 64 is slidable in the front-rear direction, and is inserted into the apparatus body 12, or drawn from the apparatus body 12. That is, each of the engagement piece 644, the engagement piece 646, the engaging portion 1262, and the engaging portion 1264 serves as an insertion and removal guide portion (guide) of the process unit 64.

In addition, when the process unit 64 is mounted (installed) on the apparatus body 12, the engagement pieces 644 and 646 are closely attached to the engaging portions 1262 and 1264 formed in a U-shape by the weight of the process unit 64 respectively, and thus it is possible to restrain the air from leaking.

In addition, the process unit 64 is provided with a cleaning blade 382 of the cleaner unit 38 and a collected toner transporting member 384 on the inside of the top wall 642. The top wall 642 is provided with inclined surfaces 6422 and 6423 inclined downward so as to be close to the cleaning blade 382 and the collected toner transporting member 384. These inclined surfaces 6422 and 6423 are formed on the upstream side of the air flow from the plurality of intake ports 92*a* and substantially right under the bottom wall of the first duct 90 (the first duct A portion 902). Therefore, the air passing above the top wall 642 of the process unit 64 flows so as to curve downwardly along the inclined surfaces 6422 and 6423, and thus the cleaning blade 382 disposed in the vicinity of the inclined surfaces 6422 and 6423 and the collected toner transporting member 384 can be effectively cooled. Therefore, it is possible to effectively restrain a cleaning defect caused by melting and fusing the toner collected by the cleaning device by the heat of the fixing portion, and a transport defect of the collected toner.

Note that, in a case where only one side of the cleaning blade 382 and the collected toner transporting member 384 is to be cooled, or a case where both are disposed relatively close to the top wall 642, a recessed inclined portion is may be formed flat without being provided in the top wall 642.

In addition, as illustrated in FIGS. 10 and 12, the gap 126 may be provided with a guide portion 128 protruding toward the process unit 64 side. Since the guide portion 128 is provided with an inclined surface inclined down toward the process unit 64 side, it is possible to cause the air flowing through the gap 126 to flow toward the process unit 64 side, and the top wall 642 of the process unit 64 can be effectively cooled.

In the third embodiment, since the gap 126 is formed between the first duct 90 and the second duct 112, and top wall 642 of the process unit 64 seals the gap 126, the air flowing through the gap 126 is in directly contact with the top wall 642 of the process unit 64, thereby effectively suppressing temperature rise in the process unit 64.

In the third embodiment, the inclined surfaces 6422 and 6423 are formed on the top wall 642 of the process unit 64, so that the flow of air passing above the top wall 642 of the process unit 64 is curved (the inside of the process unit 64 is recessed) so as to approach the cleaner unit 38. With this, it is possible to effectively cool the cleaner unit 38, suppress the temperature rise in the cleaner unit 38, and restrain a cleaning defect and a transport failure of the collected toner.

Fourth Embodiment

Since an image forming apparatus 100 of a fourth embodiment is the same as the image forming apparatus 100 of the third embodiment except that a plurality of rectifying ribs 6424 are formed on the top wall 642 of the process unit 64, contents different from those of the third embodiment will be described, and redundant explanation will not be made.

Figure 13:
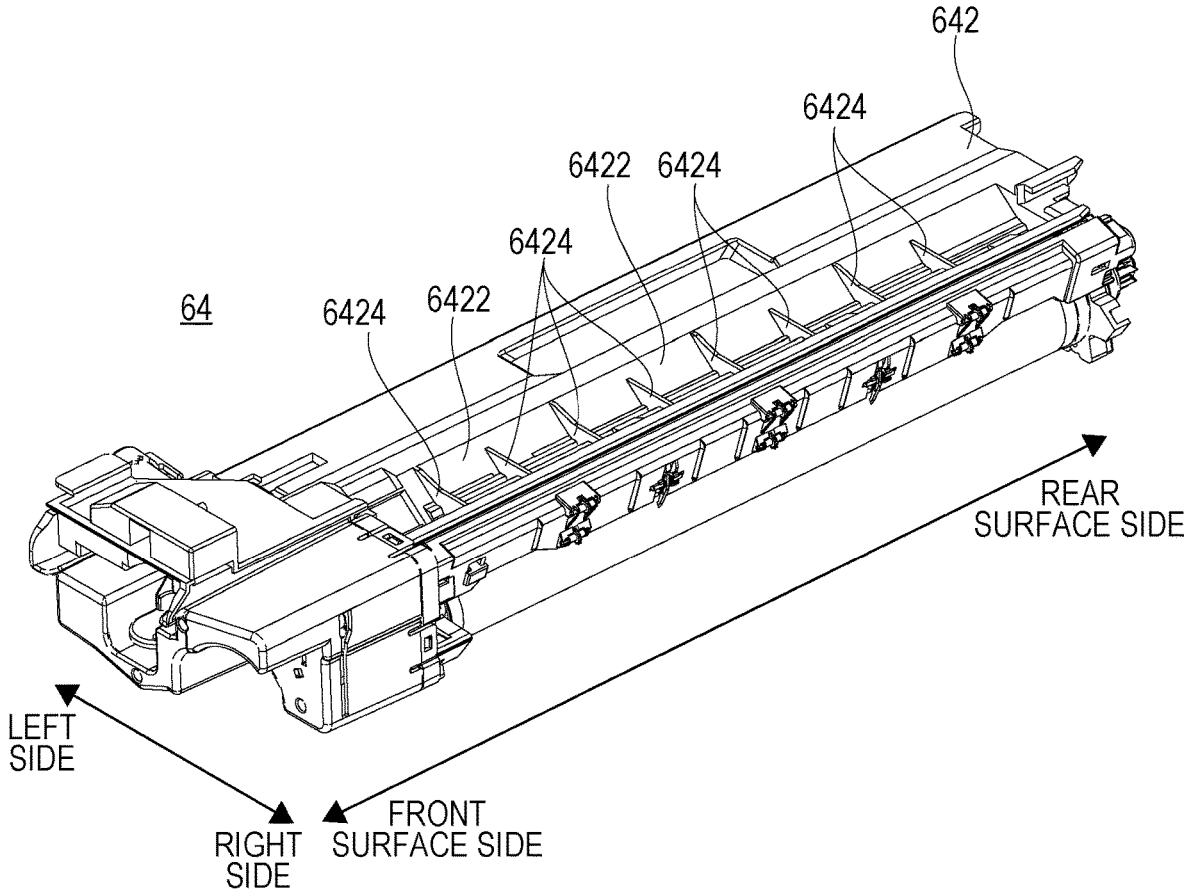
FIG. 13 is a schematic perspective view illustrating a structure of process unit of a fourth embodiment.
Figure 14:
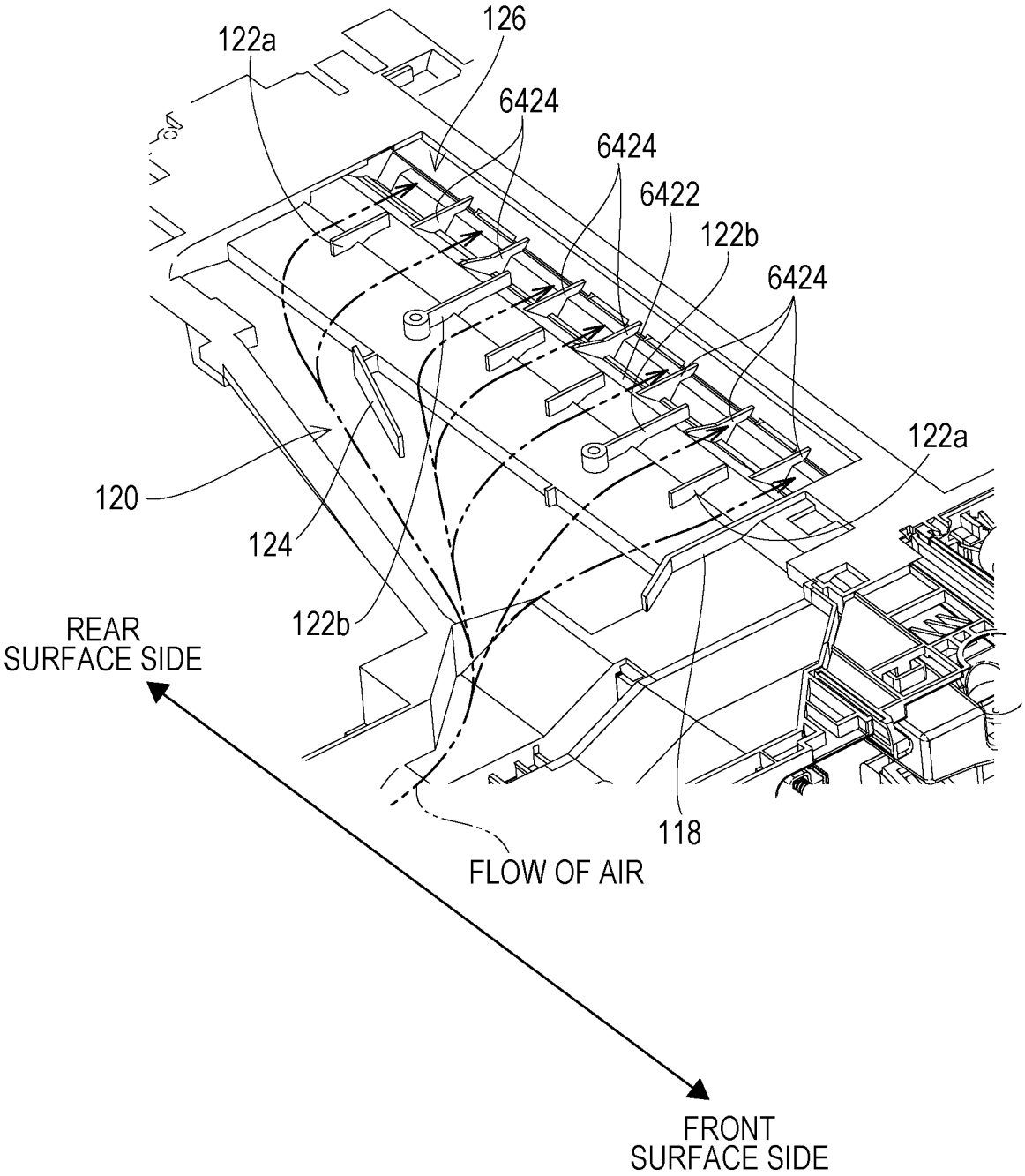
FIG. 14 is a schematic perspective view illustrating a structure of the second duct of the fourth embodiment.

FIG. 13 is a schematic perspective view illustrating a structure of process unit 64 of a fourth embodiment. FIG. 14 is a schematic perspective view illustrating a structure of the second duct 112 of the fourth embodiment.

As illustrated in FIG. 13, in the fourth embodiment, the plurality of rectifying ribs 6424 are formed on the top wall 642 of the process unit 64. Each of the plurality of rectifying ribs 6424 is a plate-shaped rib extending in the horizontal direction along the flow of air flowing through the communication portion between the first duct 90 and the second duct 112, and are disposed substantially parallel to each other with a predetermined space therebetween on the inclined surface 6422 of the top wall 642. That is, as illustrated in FIG. 14, each of the plurality of rectifying ribs 6424 is disposed in parallel to the plurality of shunt flow rectifying ribs 122. In addition, each of the plurality of rectifying ribs 6424 is disposed at a position different from the shunt flow rectifying rib 122 in the front-rear direction. That is, the plurality of rectifying ribs 6424 and the shunt flow rectifying ribs 122 are alternately arranged in the front-rear direction. The plurality of rectifying ribs 6424 are formed so as to form a gap between the guide portion 128 provided in the gap 126.

In this fourth embodiment, since the plurality of rectifying ribs 6424 are formed on the top wall 642 of the process unit 64, the surface area of the top wall 642 of the process unit 64 is increased. Therefore, it is possible to effectively suppress the temperature rise in the process unit 64.

In each of the above-described embodiments, the image forming apparatus 100 is configured as a multifunction printer; however, the image forming apparatus of the disclosure may be configured as a printer, a copying machine, or a facsimile machine.

Further, in each of the above-described embodiments, the image forming apparatus 100 is configured as a monochrome compound machine; however, the image forming apparatus of the disclosure may be configured as a color printing machine or a color multifunction printer.

Further, the specific shapes and the like exemplified in the above examples are merely examples, and can be appropriately changed according to actual products.

The present disclosure contains subject matter related to that disclosed in Japanese Priority Patent Application JP 2017-250780 filed in the Japan Patent Office on Dec. 27, 2017, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An image forming apparatus comprising:

an apparatus body, a fixing unit that heats and fixes a toner image transferred to a recording medium, a first duct disposed at a position adjacent to the fixing unit, an exhaust fan for discharging air of the first duct to an outside of the apparatus body, a second duct, and an intake fan that is provided in the second duct, suctions air outside the apparatus body from a ventilation portion provided on a side surface of the apparatus body, and sends the suctioned air to the first duct, wherein the first duct includes a plurality of intake ports arranged along the fixing unit in a longitudinal direction on an upstream side of the fixing unit in a recording sheet transport direction, the plurality of intake ports is formed such that distances to the exhaust fan are different from each other, the second duct that includes a communication portion communicating with the plurality of intake ports of the first duct, and communicates with the first duct via the communication portion and, the intake fan is disposed on an intake port side at a position farthest from the exhaust fan out of the plurality of intake ports, the second duct has a duct enlarged portion in which flow paths are sequentially spread toward the communication portion, and the duct enlarged portion is provided with a shunt plate for sending, at the duct enlarged portion, air toward a side far from the intake fan.

2. The image forming apparatus according to claim 1, wherein the first duct includes a fixing side surface duct portion along one side surface of the fixing unit, and a fixing top surface duct portion separated from the fixing side surface duct portion and extending along the top surface of the fixing unit.

3. The image forming apparatus according to claim 2, wherein a side wall of the fixing top surface duct portion on a fixing unit side is formed of a material with heat resistance.

4. The image forming apparatus according to claim 1, wherein the intake fan is disposed so that each of the plurality of intake ports is closer to the intake fan as the each becomes farther from the exhaust fan.

5. The image forming apparatus according to claim 1, wherein the duct enlarged portion is provided with a plurality of rectifying plates provided in parallel with each other on an intake portion side of the first duct, and the shunt plate is provided in order to send the air to the rectifying plate disposed at a position far from the intake fan, out of the plurality of rectifying plates.

6. The image forming apparatus according to claim 1, wherein the image forming apparatus further includes a process unit including at least a cleaning unit for removing residual toner on a surface of a photoreceptor, wherein an opening is formed in the communication portion, wherein the process unit is disposed at a position adjacent to the communication portion, and wherein a wall portion of the process unit facing the opening seals the opening to form a wall surface of the communication portion.

7. The image forming apparatus according to claim 1, wherein the image forming apparatus further includes a process unit including at least a cleaning unit for removing residual toner on a surface of a photoreceptor, wherein an opening is formed in the communication portion, and wherein the process unit is disposed at a position adjacent to the communication portion, and includes a facing wall portion which forms a communication space communicated with the opening, at a position facing the opening.

8. The image forming apparatus according to claim 7, wherein a portion of the facing wall portion is a portion of a guide portion when the process unit is attached to the image forming apparatus, and the opening is sealed by the guide portion.

9. The image forming apparatus according to claim 7, wherein the facing wall portion includes an inclined surface that an inside of the process unit is recessed.

10. The image forming apparatus according to claim 7, wherein the facing wall portion includes a rib extending along flow of air flowing in the communication portion.

* * * * *